US010602863B2

(12) United States Patent
Lee et al.

(10) Patent No.: US 10,602,863 B2
(45) Date of Patent: Mar. 31, 2020

(54) SMART CUP AND CONTROL METHOD THEREOF

(71) Applicant: LG ELECTRONICS INC., Seoul (KR)

(72) Inventors: Doyoung Lee, Seoul (KR); Myungsun Kim, Seoul (KR); Eunju Lee, Seoul (KR); Youngwoo Kim, Seoul (KR); Kihyung Kim, Seoul (KR); Jungho Yeom, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 93 days.

(21) Appl. No.: 15/754,964

(22) PCT Filed: Nov. 17, 2015

(86) PCT No.: PCT/KR2015/012316
§ 371 (c)(1),
(2) Date: Feb. 23, 2018

(87) PCT Pub. No.: WO2017/039063
PCT Pub. Date: Mar. 9, 2017

(65) Prior Publication Data

US 2019/0208938 A1 Jul. 11, 2019

(30) Foreign Application Priority Data

Aug. 31, 2015 (KR) ..... 10-2015-0123239

(51) Int. Cl.
*A47G 19/22* (2006.01)
*G09F 23/08* (2006.01)

(52) U.S. Cl.
CPC ..... *A47G 19/2227* (2013.01); *A47G 19/2272* (2013.01); *G09F 23/08* (2013.01);
(Continued)

(58) Field of Classification Search
None
See application file for complete search history.

(56) References Cited

U.S. PATENT DOCUMENTS

| | | | | |
|---|---|---|---|---|
| 3,915,355 | A | 10/1975 | Young | |
| 10,010,213 | B2 * | 7/2018 | Alexander | A47J 36/2472 |
| 2018/0364557 | A1 * | 12/2018 | Park | G04G 21/00 |

FOREIGN PATENT DOCUMENTS

| | | | |
|---|---|---|---|
| CN | 104783615 | A | 7/2015 |
| JP | 2004-290020 | A | 10/2004 |

(Continued)

*Primary Examiner* — Ashok Patel
(74) *Attorney, Agent, or Firm* — Birch, Stewart, Kolasch & Birch, LLP

(57) ABSTRACT

A smart cup including a main body having an opening; a cover configured to cover at least one portion of the opening; a driving unit configured to move the cover to open and close the at least one portion of the opening; a motion sensor configured to sense a motion of the main body; a proximity sensor configured to sense an object contacted with or adjacent to the opening; and a controller configured to control the driving unit to move the cover to open the at least one portion of the opening in response to the motion sensor sensing the motion of the main body and the proximity sensor sensing the object contacted with or adjacent to the opening, and control the driving unit to move the cover to close the at least one portion of the opening in response to the motion sensor sensing the motion of the main body and the proximity sensor not sensing the object contacted with or adjacent to the opening.

20 Claims, 16 Drawing Sheets

(52) U.S. Cl.
CPC ..... *A47G 2019/225* (2013.01); *A47G 2019/2238* (2013.01); *A47G 2019/2244* (2013.01); *A47G 2200/143* (2013.01); *A47G 2200/166* (2013.01)

(56) References Cited

FOREIGN PATENT DOCUMENTS

| | | | |
|---|---|---|---|
| KR | 10-0531762 | B1 | 11/2005 |
| KR | 10-2015-0038974 | A | 4/2015 |

* cited by examiner

SMART CUP AND CONTROL METHOD THEREOF

CROSS-REFERENCE TO RELATED APPLICATIONS

This application is the National Phase of PCT International Application No. PCT/KR2015/012316, filed on Nov. 17, 2015, which claims priority under 35 U.S.C. § 119(a) to Patent Application No. 10-2015-0123239, filed in Republic of Korea on Aug. 31, 2015, all of which are hereby expressly incorporated by reference into the present application.

BACKGROUND OF THE INVENTION

Technical Field

The present disclosure relates to a smart cup including a function of containing a drinking substance and a control method thereof.

Background Art

Terminals may be generally classified as mobile/portable terminals or stationary terminals according to their mobility. Mobile terminals may also be classified as handheld terminals or vehicle mounted terminals according to whether or not a user can directly carry the terminal.

Mobile terminals have become increasingly more functional. Examples of such functions include data and voice communications, capturing images and video via a camera, recording audio, playing music files via a speaker system, and displaying images and video on a display. Some mobile terminals include additional functionality which supports game playing, while other terminals are configured as multimedia players. More recently, mobile terminals have been configured to receive broadcast and multicast signals which permit viewing of content such as videos and television programs.

Efforts are ongoing to support and increase the functionality of mobile terminals. Such efforts include software and hardware improvements, as well as changes and improvements in the structural components.

Meanwhile, as technologies of mobile terminals are developed, the technologies of the mobile terminals have recently been applied to various devices that were not conventionally available.

As an example, the technologies of the mobile terminals have been applied to cups formed to contain drinking substances. These cups may be called as smart cups, active smart tumblers, smart tumblers, etc.

Meanwhile, in the case of a cup formed to contain a drinking substance, the cup should provide an additionally available function while maintaining a function of containing a drinking substance, which is the original function. Accordingly, there is proposed a method of using additional functions of a cup while maintaining the original function of the cup.

SUMMARY OF THE INVENTION

Therefore, an object of the present disclosure is to provide a smart cup and a control method thereof, which can prevent a drinking substance from being discharged to the outside.

Another object of the present disclosure is to provide a smart cup and a control method thereof, which can simultaneously provide a function of containing a drinking substance and a function related to the drinking substance.

Still another object of the present disclosure is to provide a smart cup and a control method thereof, which can conveniently provide various functions related to a drinking substance.

To achieve these and other advantages and in accordance with the purpose of the present disclosure, as embodied and broadly described herein, there is provided a smart cup including: a main body configured to include an opening; a cover configured to cover at least one portion of the opening; a driving unit formed to move the cover; a motion sensing unit configured to sense a motion of the main body; a proximity sensor configured to sense an object contacted with or adjacent to the opening; and a controller configured to control the driving unit such that, if a motion of the main body is sensed, the cover covers at least one portion of the opening, based on whether there exists an object contacted with or adjacent to the opening.

When there exists an object contacted with or adjacent to the opening, the controller may control the driving unit such that the cover does not cover at least one portion of the opening. When there exists no object contacted with or adjacent to the opening, the controller may control the driving unit such that the cover covers at least one portion of the opening.

The main body may include an internal space configured to contain a drinking substance therein. The smart cup may further include a drinking substance sensing unit configured to sense information related to the drinking substance contained in the internal space of the main body. The controller may determine a speed at which the cover is moved according to a capacity of the drinking substance.

The main body may include an internal space configured to contain a drinking substance and an outside surrounding the internal space. The smart cup may further include a touch screen configured to surround at least one portion of the outside of the main body. When there exists no object contacted with or adjacent to the opening in the state in which the motion of the main body is sensed, the controller may execute any one of a first function and a second function, based on an area in which a touch is sensed on the touch screen.

The first function may be a function of moving the cover such that the drinking substance contained in the internal space of the main body is discharged, and the second function may be a function of transmitting, to an external device, information displayed in the area in which the touch is sensed, through wireless communication.

When there exists no object contacted with or adjacent to the opening in the state in which the motion of the main body is sensed, the controller may display a graphic object related to the first function and a graphic object related to the second function in an area contacted with or adjacent to a user's finger on the display unit.

The main body may include an internal space configured to contain a drinking substance and an outside surrounding the internal space. The smart cup may further include a display unit configured to surround at least one portion of the main body, and a drinking substance sensing unit configured to sense information related to the drinking substance contained in the internal space of the main body. The controller may display additional information on the display unit, based on the information related to the drinking substance contained in the internal space.

The information related to the drinking substance may be at least one of a kind of the drinking substance, a manufacturer of the drinking substance, calorie information of the drinking substance, a capacity of the drinking substance, a specific component included in the drinking substance, and a concentration of the specific component.

The additional information may be recipe information corresponding to the kind of the drinking substance contained in the internal substance.

The controller may divide the display unit into a plurality of areas, based on the capacity of the drinking substance contained in the internal space, display the information related to the drinking substance in an area corresponding to an internal space in which the drinking substance is contained among the plurality of areas, and display screen information of a function being executed in the smart cup in an area corresponding to an internal space in which the drinking substance is not contained among the plurality of areas.

The controller may change sizes of the plurality of areas, based on a drag applied to a boundary area between the plurality of areas.

The controller may change a display degree of screen information displayed in each of the plurality of areas, based on that the sizes of the plurality of areas are changed.

The controller may display guide information for representing a capacity of the drinking substance even though the sizes of the plurality of areas are changed.

The smart cup may further include a position sensing unit configured to sense position information, and a display unit. When a position sensed through the position sensing unit corresponds to a predetermined position, the controller may display, on the display unit, information related to the predetermined position.

The information related to the predetermined position may be at least one of shop information, discount coupon information, and menu information.

To achieve these and other advantages and in accordance with the purpose of the present disclosure, as embodied and broadly described herein, there is provided a method of controlling a smart cup, the method including: sensing a motion of a main body including an opening; sensing an object contacted with or adjacent to the opening; and if a motion of the main body is sensed, controlling a driving unit such that a cover covers at least one portion of the opening, based on whether there exists an object contacted with or adjacent to the opening.

When there exists an object contacted with or adjacent to the opening, the cover may be controlled not to cover at least one portion of the opening. When there exists no object contacted with or adjacent to the opening, the cover may be controlled to cover at least one portion of the opening.

The method may further include when there exists no object contacted with or adjacent to the opening, sensing an area of a touch applied on a touch screen surrounding the main body; and if the motion of the main body is sensed, executing any one of a first function and a second function, based on the area of the touch.

The method may further include displaying graphic objects respectively related to the first and second functions on an area adjacent to the area of the touch applied on the touch screen.

The first function may be a function of controlling the cover, and the second function may be a function of transmitting, to an external device, information displayed in the area of the touch, through wireless communication.

The smart cup according to the embodiment of the present disclosure can execute various functions, based on a motion of the main body and information related to a drinking substance. Thus, the user can use various functions as well as the function of containing the drinking substance by using the smart cup.

Also, the smart cup according to the embodiment of the present disclosure prevents a drinking substance from being discharged to the outside when additional functions are executed except the function of containing the drinking substance, so that it is possible to simultaneously use the function of containing the drinking substance and the additional functions.

DETAILED DESCRIPTION OF THE EMBODIMENTS

Figure 1:
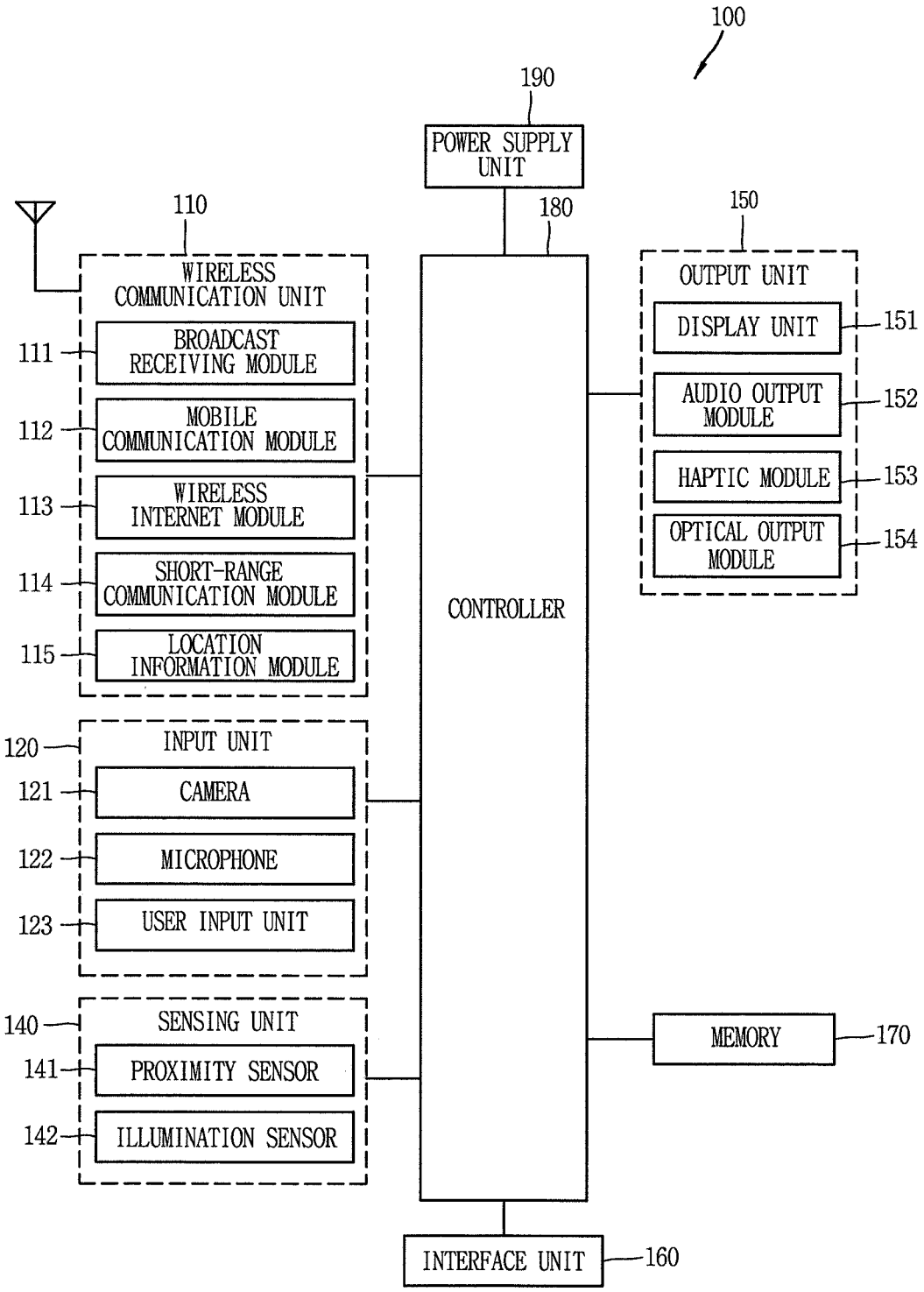
FIG. 1 is a block diagram illustrating a mobile terminal according to an embodiment of the present disclosure.

Description will now be given in detail according to exemplary embodiments disclosed herein, with reference to the accompanying drawings. For the sake of brief description with reference to the drawings, the same or equivalent components may be provided with the same or similar reference numbers, and description thereof will not be repeated. In general, a suffix such as "module" and "unit" may be used to refer to elements or components. Use of such a suffix herein is merely intended to facilitate description of the specification, and the suffix itself is not intended to give any special meaning or function. In the present disclosure, that which is well-known to one of ordinary skill in the relevant art has generally been omitted for the sake of brevity. The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

It will be understood that although the terms first, second, etc. may be used herein to describe various elements, these elements should not be limited by these terms. These terms are generally only used to distinguish one element from another.

It will be understood that when an element is referred to as being "connected with" another element, the element can be connected with the other element or intervening elements may also be present. In contrast, when an element is referred to as being "directly connected with" another element, there are no intervening elements present.

A singular representation may include a plural representation unless it represents a definitely different meaning from the context. Terms such as "include" or "has" are used herein and should be understood that they are intended to indicate an existence of several components, functions or steps, disclosed in the specification, and it is also understood that greater or fewer components, functions, or steps may likewise be utilized.

Mobile terminals presented herein may be implemented using a variety of different types of terminals. Examples of such terminals include cellular phones, smart phones, user equipment, laptop computers, digital broadcast terminals, personal digital assistants (PDAs), portable multimedia players (PMPs), navigators, portable computers (PCs), slate PCs, tablet PCs, ultra books, wearable devices (for example, smart watches, smart glasses, head mounted displays (HMDs)), and the like.

By way of non-limiting example only, further description will be made with reference to particular types of mobile terminals. However, such teachings apply equally to other types of terminals, such as those types noted above. In addition, these teachings may also be applied to stationary terminals such as digital TV, desktop computers, and the like.

Reference is now made to FIG. 1, a block diagram of a mobile terminal in accordance with the present disclosure.

The mobile terminal 100 is shown having components such as a wireless communication unit 110, an input unit 120, a sensing unit 140, an output unit 150, an interface unit 160, a memory 170, a controller 180, and a power supply unit 190. It is understood that implementing all of the illustrated components is not a requirement, and that greater or fewer components may alternatively be implemented.

Referring now to FIG. 1, the mobile terminal 100 is shown having wireless communication unit 110 configured with several commonly implemented components. For instance, the wireless communication unit 110 typically includes one or more components which permit wireless communication between the mobile terminal 100 and a wireless communication system or network within which the mobile terminal is located.

The wireless communication unit 110 typically includes one or more modules which permit communications such as wireless communications between the mobile terminal 100 and a wireless communication system, communications between the mobile terminal 100 and another mobile terminal, communications between the mobile terminal 100 and an external server. Further, the wireless communication unit 110 typically includes one or more modules which connect the mobile terminal 100 to one or more networks. To facilitate such communications, the wireless communication unit 110 includes one or more of a broadcast receiving module 111, a mobile communication module 112, a wireless Internet module 113, a short-range communication module 114, and a location information module 115.

The input unit 120 includes a camera 121 for obtaining images or video, a microphone 122, which is one type of audio input device for inputting an audio signal, and a user input unit 123 (for example, a touch key, a push key, a mechanical key, a soft key, and the like) for allowing a user to input information. Data (for example, audio, video, image, and the like) is obtained by the input unit 120 and may be analyzed and processed by controller 180 according to device parameters, user commands, and combinations thereof.

The sensing unit 140 is typically implemented using one or more sensors configured to sense internal information of the mobile terminal, the surrounding environment of the mobile terminal, user information, and the like. For example, in FIG. 1, the sensing unit 140 is shown having a proximity sensor 141 and an illumination sensor 142.

If desired, the sensing unit 140 may alternatively or additionally include other types of sensors or devices, such as a touch sensor, an acceleration sensor, a magnetic sensor, a G-sensor, a gyroscope sensor, a motion sensor, an RGB sensor, an infrared (IR) sensor, a finger scan sensor, a ultrasonic sensor, an optical sensor (for example, camera 121), a microphone 122, a battery gauge, an environment sensor (for example, a barometer, a hygrometer, a thermometer, a radiation detection sensor, a thermal sensor, and a gas sensor, among others), and a chemical sensor (for example, an electronic nose, a health care sensor, a biometric sensor, and the like), to name a few. The mobile terminal 100 may be configured to utilize information obtained from sensing unit 140, and in particular, information obtained from one or more sensors of the sensing unit 140, and combinations thereof.

The output unit 150 is typically configured to output various types of information, such as audio, video, tactile output, and the like. The output unit 150 is shown having a display unit 151, an audio output module 152, a haptic module 153, and an optical output module 154.

The display unit 151 may have an inter-layered structure or an integrated structure with a touch sensor in order to facilitate a touch screen. The touch screen may provide an output interface between the mobile terminal 100 and a user, as well as function as the user input unit 123 which provides an input interface between the mobile terminal 100 and the user.

The interface unit 160 serves as an interface with various types of external devices that can be coupled to the mobile terminal 100. The interface unit 160, for example, may include any of wired or wireless ports, external power supply ports, wired or wireless data ports, memory card ports, ports for connecting a device having an identification module, audio input/output (I/O) ports, video I/O ports, earphone ports, and the like. In some cases, the mobile terminal 100 may perform assorted control functions associated with a connected external device, in response to the external device being connected to the interface unit 160.

The memory 170 is typically implemented to store data to support various functions or features of the mobile terminal 100. For instance, the memory 170 may be configured to store application programs executed in the mobile terminal 100, data or instructions for operations of the mobile terminal 100, and the like. Some of these application programs may be downloaded from an external server via wireless communication. Other application programs may be installed within the mobile terminal 100 at time of manufacturing or shipping, which is typically the case for basic functions of the mobile terminal 100 (for example, receiving a call, placing a call, receiving a message, sending a message, and the like). It is common for application programs to be stored in the memory 170, installed in the mobile terminal 100, and executed by the controller 180 to perform an operation (or function) for the mobile terminal 100.

The controller 180 typically functions to control overall operation of the mobile terminal 100, in addition to the operations associated with the application programs. The controller 180 may provide or process information or functions appropriate for a user by processing signals, data, information and the like, which are input or output by the various components depicted in FIG. 1, or activating application programs stored in the memory 170. As one example, the controller 180 controls some or all of the components illustrated in FIG. 1 according to the execution of an application program that have been stored in the memory 170.

The power supply unit 190 can be configured to receive external power or provide internal power in order to supply appropriate power required for operating elements and components included in the mobile terminal 100. The power supply unit 190 may include a battery, and the battery may be configured to be embedded in the terminal body, or configured to be detachable from the terminal body.

At least some of the above components may operate in a cooperating manner, so as to implement an operation or a control method for a glass type terminal according to various embodiments to be explained later. The operation or the control method for the glass type terminal may be implemented on the glass type terminal by driving at least one application program stored in the memory 170.

Referring still to FIG. 1, various components depicted in this figure will now be described in more detail. Regarding the wireless communication unit 110, the broadcast receiving module 111 is typically configured to receive a broadcast signal and/or broadcast associated information from an external broadcast managing entity via a broadcast channel. The broadcast channel may include a satellite channel, a terrestrial channel, or both. In some embodiments, two or more broadcast receiving modules 111 may be utilized to facilitate simultaneously receiving of two or more broadcast channels, or to support switching among broadcast channels.

The mobile communication module 112 can transmit and/or receive wireless signals to and from one or more network entities. Typical examples of a network entity include a base station, an external mobile terminal, a server, and the like. Such network entities form part of a mobile communication network, which is constructed according to technical standards or communication methods for mobile communications (for example, Global System for Mobile Communication (GSM), Code Division Multi Access (CDMA), CDMA2000 (Code Division Multi Access 2000), EV-DO (Enhanced Voice-Data Optimized or Enhanced Voice-Data Only), Wideband CDMA (WCDMA), High Speed Downlink Packet access (HSDPA), HSUPA (High Speed Uplink Packet Access), Long Term Evolution (LTE), LTE-A (Long Term Evolution-Advanced), and the like). Examples of wireless signals transmitted and/or received via the mobile communication module 112 include audio call signals, video (telephony) call signals, or various formats of data to support communication of text and multimedia messages.

The wireless Internet module 113 is configured to facilitate wireless Internet access. This module may be internally or externally coupled to the mobile terminal 100. The wireless Internet module 113 may transmit and/or receive wireless signals via communication networks according to wireless Internet technologies.

Examples of such wireless Internet access include Wireless LAN (WLAN), Wireless Fidelity (Wi-Fi), Wi-Fi Direct, Digital Living Network Alliance (DLNA), Wireless Broadband (WiBro), Worldwide Interoperability for Microwave Access (WiMAX), High Speed Downlink Packet Access (HSDPA), HSUPA (High Speed Uplink Packet Access), Long Term Evolution (LTE), LTE-A (Long Term Evolution-Advanced), and the like. The wireless Internet module 113 may transmit/receive data according to one or more of such wireless Internet technologies, and other Internet technologies as well.

In some embodiments, when the wireless Internet access is implemented according to, for example, WiBro, HSDPA, HSUPA, GSM, CDMA, WCDMA, LTE, LTE-A and the like, as part of a mobile communication network, the wireless Internet module 113 performs such wireless Internet access. As such, the Internet module 113 may cooperate with, or function as, the mobile communication module 112.

The short-range communication module 114 is configured to facilitate short-range communications. Suitable technologies for implementing such short-range communications include BLUETOOTH™, Radio Frequency IDentification (RFID), Infrared Data Association (IrDA), Ultra-WideBand (UWB), ZigBee, Near Field Communication (NFC), Wireless-Fidelity (Wi-Fi), Wi-Fi Direct, Wireless USB (Wireless Universal Serial Bus), and the like. The short-range communication module 114 in general supports wireless communications between the mobile terminal 100 and a wireless communication system, communications between the mobile terminal 100 and another mobile terminal 100, or communications between the mobile terminal and a network where another mobile terminal 100 (or an external server) is located, via wireless area networks. One example of the wireless area networks is a wireless personal area networks.

In some embodiments, another mobile terminal (which may be configured similarly to mobile terminal 100) may be a wearable device, for example, a smart watch, a smart glass or a head mounted display (HMD), which is able to exchange data with the mobile terminal 100 (or otherwise cooperate with the mobile terminal 100). The short-range communication module 114 may sense or recognize the wearable device, and permit communication between the wearable device and the mobile terminal 100. In addition, when the sensed wearable device is a device which is authenticated to communicate with the mobile terminal 100, the controller 180, for example, may cause transmission of data processed in the mobile terminal 100 to the wearable device via the short-range communication module 114. Hence, a user of the wearable device may use the data processed in the mobile terminal 100 on the wearable device. For example, when a call is received in the mobile terminal 100, the user may answer the call using the wearable device. Also, when a message is received in the mobile terminal 100, the user can check the received message using the wearable device.

The location information module 115 is generally configured to detect, calculate, derive or otherwise identify a position of the mobile terminal. As an example, the location information module 115 includes a Global Position System (GPS) module, a Wi-Fi module, or both. If desired, the location information module 115 may alternatively or additionally function with any of the other modules of the wireless communication unit 110 to obtain data related to the position of the mobile terminal.

As one example, when the mobile terminal uses a GPS module, a position of the mobile terminal may be acquired using a signal sent from a GPS satellite. As another example, when the mobile terminal uses the Wi-Fi module, a position of the mobile terminal can be acquired based on information related to a wireless access point (AP) which transmits or receives a wireless signal to or from the Wi-Fi module.

The input unit 120 may be configured to permit various types of input to the mobile terminal 120. Examples of such input include audio, image, video, data, and user input. Image and video input is often obtained using one or more cameras 121. Such cameras 121 may process image frames of still pictures or video obtained by image sensors in a video or image capture mode. The processed image frames can be displayed on the display unit 151 or stored in memory 170. In some cases, the cameras 121 may be arranged in a matrix configuration to permit a plurality of images having various angles or focal points to be input to the mobile terminal 100. As another example, the cameras 121 may be located in a stereoscopic arrangement to acquire left and right images for implementing a stereoscopic image.

The microphone 122 is generally implemented to permit audio input to the mobile terminal 100. The audio input can be processed in various manners according to a function being executed in the mobile terminal 100. If desired, the microphone 122 may include assorted noise removing algorithms to remove unwanted noise generated in the course of receiving the external audio.

The user input unit 123 is a component that permits input by a user. Such user input may enable the controller 180 to control operation of the mobile terminal 100. The user input unit 123 may include one or more of a mechanical input element (for example, a key, a button located on a front and/or rear surface or a side surface of the mobile terminal 100, a dome switch, a jog wheel, a jog switch, and the like), or a touch-sensitive input, among others. As one example, the touch-sensitive input may be a virtual key or a soft key, which is displayed on a touch screen through software processing, or a touch key which is located on the mobile terminal at a location that is other than the touch screen. On the other hand, the virtual key or the visual key may be displayed on the touch screen in various shapes, for example, graphic, text, icon, video, or a combination thereof.

The sensing unit 140 is generally configured to sense one or more of internal information of the mobile terminal, surrounding environment information of the mobile terminal, user information, or the like. The controller 180 generally cooperates with the sending unit 140 to control operation of the mobile terminal 100 or execute data processing, a function or an operation associated with an application program installed in the mobile terminal based on the sensing provided by the sensing unit 140. The sensing unit 140 may be implemented using any of a variety of sensors, some of which will now be described in more detail.

The proximity sensor 141 may include a sensor to sense presence or absence of an object approaching a surface, or an object located near a surface, by using an electromagnetic field, infrared rays, or the like without a mechanical contact. The proximity sensor 141 may be arranged at an inner region of the mobile terminal covered by the touch screen, or near the touch screen.

The proximity sensor 141, for example, may include any of a transmissive type photoelectric sensor, a direct reflective type photoelectric sensor, a mirror reflective type photoelectric sensor, a high-frequency oscillation proximity sensor, a capacitance type proximity sensor, a magnetic type proximity sensor, an infrared rays proximity sensor, and the like. When the touch screen is implemented as a capacitance type, the proximity sensor 141 can sense proximity of a pointer relative to the touch screen by changes of an electromagnetic field, which is responsive to an approach of an object with conductivity. In this case, the touch screen (touch sensor) may also be categorized as a proximity sensor.

The term "proximity touch" will often be referred to herein to denote the scenario in which a pointer is positioned to be proximate to the touch screen without contacting the touch screen. The term "contact touch" will often be referred to herein to denote the scenario in which a pointer makes physical contact with the touch screen. For the position corresponding to the proximity touch of the pointer relative to the touch screen, such position will correspond to a position where the pointer is perpendicular to the touch screen. The proximity sensor 141 may sense proximity touch, and proximity touch patterns (for example, distance, direction, speed, time, position, moving status, and the like).

In general, controller 180 processes data corresponding to proximity touches and proximity touch patterns sensed by the proximity sensor 141, and cause output of visual information on the touch screen. In addition, the controller 180 can control the mobile terminal 100 to execute different operations or process different data according to whether a touch with respect to a point on the touch screen is either a proximity touch or a contact touch.

A touch sensor can sense a touch applied to the touch screen, such as display unit 151, using any of a variety of touch methods. Examples of such touch methods include a resistive type, a capacitive type, an infrared type, and a magnetic field type, among others.

As one example, the touch sensor may be configured to convert changes of pressure applied to a specific part of the display unit 151, or convert capacitance occurring at a specific part of the display unit 151, into electric input signals. The touch sensor may also be configured to sense not only a touched position and a touched area, but also touch pressure and/or touch capacitance. A touch object is generally used to apply a touch input to the touch sensor. Examples of typical touch objects include a finger, a touch pen, a stylus pen, a pointer, or the like.

When a touch input is sensed by a touch sensor, corresponding signals may be transmitted to a touch controller. The touch controller may process the received signals, and then transmit corresponding data to the controller 180. Accordingly, the controller 180 may sense which region of the display unit 151 has been touched. Here, the touch controller may be a component separate from the controller 180, the controller 180, and combinations thereof.

In some embodiments, the controller 180 may execute the same or different controls according to a type of touch object that touches the touch screen or a touch key provided in addition to the touch screen. Whether to execute the same or different control according to the object which provides a touch input may be decided based on a current operating state of the mobile terminal 100 or a currently executed application program, for example.

The touch sensor and the proximity sensor may be implemented individually, or in combination, to sense various types of touches. Such touches includes a short (or tap) touch, a long touch, a multi-touch, a drag touch, a flick touch, a pinch-in touch, a pinch-out touch, a swipe touch, a hovering touch, and the like.

If desired, an ultrasonic sensor may be implemented to recognize position information relating to a touch object using ultrasonic waves. The controller 180, for example, may calculate a position of a wave generation source based on information sensed by an illumination sensor and a plurality of ultrasonic sensors. Since light is much faster than ultrasonic waves, the time for which the light reaches the optical sensor is much shorter than the time for which the ultrasonic wave reaches the ultrasonic sensor. The position of the wave generation source may be calculated using this fact. For instance, the position of the wave generation source may be calculated using the time difference from the time that the ultrasonic wave reaches the sensor based on the light as a reference signal.

The camera 121 typically includes at least one a camera sensor (CCD, CMOS etc.), a photo sensor (or image sensors), and a laser sensor.

Implementing the camera 121 with a laser sensor may allow detection of a touch of a physical object with respect to a 3D stereoscopic image. The photo sensor may be laminated on, or overlapped with, the display device. The photo sensor may be configured to scan movement of the physical object in proximity to the touch screen. In more detail, the photo sensor may include photo diodes and transistors at rows and columns to scan content received at the photo sensor using an electrical signal which changes according to the quantity of applied light. Namely, the photo sensor may calculate the coordinates of the physical object according to variation of light to thus obtain position information of the physical object.

The display unit 151 is generally configured to output information processed in the mobile terminal 100. For example, the display unit 151 may display execution screen information of an application program executing at the mobile terminal 100 or user interface (UI) and graphic user interface (GUI) information in response to the execution screen information.

In some embodiments, the display unit 151 may be implemented as a stereoscopic display unit for displaying stereoscopic images. A typical stereoscopic display unit may employ a stereoscopic display scheme such as a stereoscopic scheme (a glass scheme), an auto-stereoscopic scheme (glassless scheme), a projection scheme (holographic scheme), or the like.

The audio output module 152 is generally configured to output audio data. Such audio data may be obtained from any of a number of different sources, such that the audio data may be received from the wireless communication unit 110 or may have been stored in the memory 170. The audio data may be output during modes such as a signal reception mode, a call mode, a record mode, a voice recognition mode, a broadcast reception mode, and the like. The audio output module 152 can provide audible output related to a particular function (e.g., a call signal reception sound, a message reception sound, etc.) performed by the mobile terminal 100. The audio output module 152 may also be implemented as a receiver, a speaker, a buzzer, or the like.

A haptic module 153 can be configured to generate various tactile effects that a user feels, perceive, or otherwise experience. A typical example of a tactile effect generated by the haptic module 153 is vibration. The strength, pattern and the like of the vibration generated by the haptic module 153 can be controlled by user selection or setting by the controller. For example, the haptic module 153 may output different vibrations in a combining manner or a sequential manner.

Besides vibration, the haptic module 153 can generate various other tactile effects, including an effect by stimulation such as a pin arrangement vertically moving to contact skin, a spray force or suction force of air through a jet orifice or a suction opening, a touch to the skin, a contact of an electrode, electrostatic force, an effect by reproducing the sense of cold and warmth using an element that can absorb or generate heat, and the like.

The haptic module 153 can also be implemented to allow the user to feel a tactile effect through a muscle sensation such as the user's fingers or arm, as well as transferring the tactile effect through direct contact. Two or more haptic modules 153 may be provided according to the particular configuration of the mobile terminal 100.

An optical output module 154 can output a signal for indicating an event generation using light of a light source. Examples of events generated in the mobile terminal 100 may include message reception, call signal reception, a missed call, an alarm, a schedule notice, an email reception, information reception through an application, and the like.

A signal output by the optical output module 154 may be implemented in such a manner that the mobile terminal emits monochromatic light or light with a plurality of colors. The signal output may be terminated as the mobile terminal senses that a user has checked the generated event, for example.

The interface unit 160 serves as an interface for external devices to be connected with the mobile terminal 100. For example, the interface unit 160 can receive data transmitted from an external device, receive power to transfer to elements and components within the mobile terminal 100, or transmit internal data of the mobile terminal 100 to such external device. The interface unit 160 may include wired or wireless headset ports, external power supply ports, wired or wireless data ports, memory card ports, ports for connecting a device having an identification module, audio input/output (I/O) ports, video I/O ports, earphone ports, or the like.

The identification module may be a chip that stores various information for authenticating authority of using the mobile terminal 100 and may include a user identity module (UIM), a subscriber identity module (SIM), a universal subscriber identity module (USIM), and the like. In addition, the device having the identification module (also referred to herein as an "identifying device") may take the form of a smart card. Accordingly, the identifying device can be connected with the terminal 100 via the interface unit 160.

When the mobile terminal 100 is connected with an external cradle, the interface unit 160 can serve as a passage to allow power from the cradle to be supplied to the mobile terminal 100 or may serve as a passage to allow various command signals input by the user from the cradle to be transferred to the mobile terminal there through. Various command signals or power input from the cradle may operate as signals for recognizing that the mobile terminal is properly mounted on the cradle.

The memory 170 can store programs to support operations of the controller 180 and store input/output data (for example, phonebook, messages, still images, videos, etc.).

The memory 170 may store data related to various patterns of vibrations and audio which are output in response to touch inputs on the touch screen.

The memory 170 may include one or more types of storage mediums including a Flash memory, a hard disk, a solid state disk, a silicon disk, a multimedia card micro type, a card-type memory (e.g., SD or DX memory, etc), a Random Access Memory (RAM), a Static Random Access Memory (SRAM), a Read-Only Memory (ROM), an Electrically Erasable Programmable Read-Only Memory (EEPROM), a Programmable Read-Only memory (PROM), a magnetic memory, a magnetic disk, an optical disk, and the like. The mobile terminal 100 may also be operated in relation to a network storage device that performs the storage function of the memory 170 over a network, such as the Internet.

The controller 180 may typically control the general operations of the mobile terminal 100. For example, the controller 180 may set or release a lock state for restricting a user from inputting a control command with respect to applications when a status of the mobile terminal meets a preset condition.

The controller 180 can also perform the controlling and processing associated with voice calls, data communications, video calls, and the like, or perform pattern recognition processing to recognize a handwriting input or a picture drawing input performed on the touch screen as characters or images, respectively. In addition, the controller 180 can control one or a combination of those components in order to implement various exemplary embodiments disclosed herein.

The power supply unit 190 receives external power or provide internal power and supply the appropriate power required for operating respective elements and components included in the mobile terminal 100. The power supply unit 190 may include a battery, which is typically rechargeable or be detachably coupled to the terminal body for charging.

The power supply unit 190 may include a connection port. The connection port may be configured as one example of the interface unit 160 to which an external charger for supplying power to recharge the battery is electrically connected.

As another example, the power supply unit 190 may be configured to recharge the battery in a wireless manner without use of the connection port. In this example, the power supply unit 190 can receive power, transferred from an external wireless power transmitter, using at least one of an inductive coupling method which is based on magnetic induction or a magnetic resonance coupling method which is based on electromagnetic resonance.

Various embodiments described herein may be implemented in a computer-readable medium, a machine-readable medium, or similar medium using, for example, software, hardware, or any combination thereof.

Figure 2A:
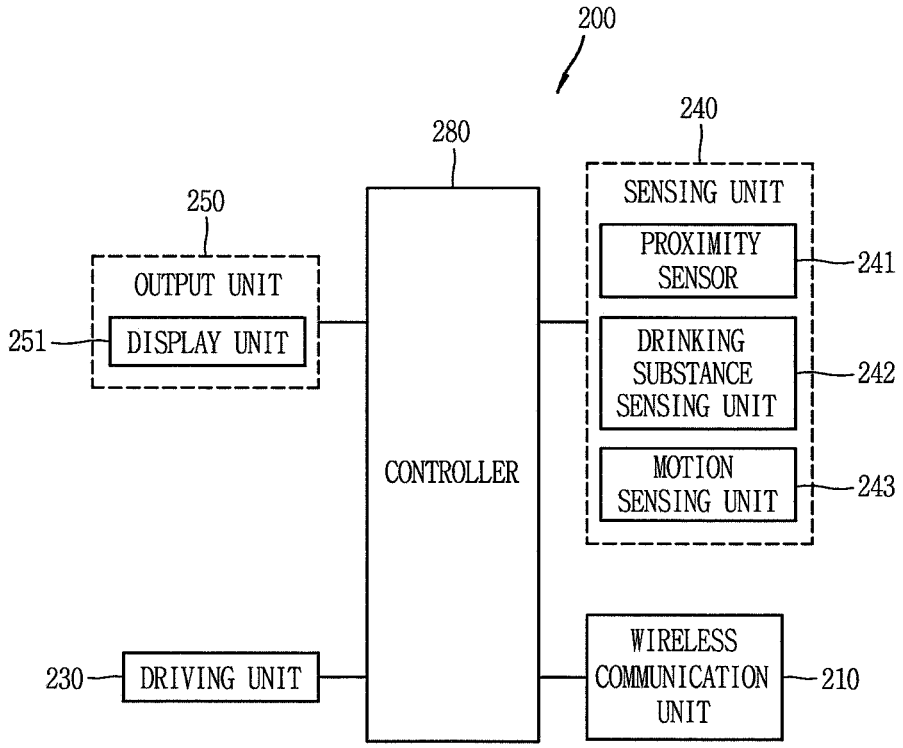
FIG. 2A is a block diagram illustrating components of a smart cup according to an embodiment of the present disclosure.

A mobile terminal 200 is shown in FIG. 2A to have an output unit 250 including display unit 251, which is a type of display that is deformable by an external force. This deformation, which includes display unit 251 and other components of mobile terminal 200, may include any of curving, bending, folding, twisting, rolling, and combinations thereof. The deformable display unit 251 may also be referred to as a "flexible display unit." In some implementations, the flexible display unit 251 may include a general flexible display, electronic paper (also known as e-paper), and combinations thereof.

The flexible display of mobile terminal 200 is generally formed as a lightweight, non-fragile display, which still exhibits characteristics of a conventional flat panel display, but is instead fabricated on a flexible substrate which can be deformed as noted previously.

The term e-paper may be used to refer to a display technology employing the characteristic of a general ink, and is different from the conventional flat panel display in view of using reflected light. E-paper is generally understood as changing displayed information using a twist ball or via electrophoresis using a capsule.

When in a state that the flexible display unit 251 is not deformed (for example, in a state with an infinite radius of curvature and referred to as a first state), a display region of the flexible display unit 251 includes a generally flat surface. When in a state that the flexible display unit 251 is deformed from the first state by an external force (for example, a state with a finite radius of curvature and referred to as a second state), the display region may become a curved surface or a bent surface. As illustrated, information displayed in the second state may be visual information output on the curved surface. The visual information may be realized in such a manner that a light emission of each unit pixel (sub-pixel) arranged in a matrix configuration is controlled independently. The unit pixel denotes an elementary unit for representing one color.

According to one alternative embodiment, the first state of the flexible display unit 251 may be a curved state (for example, a state of being curved from up to down or from right to left), instead of being in flat state. In this embodiment, when an external force is applied to the flexible display unit 251, the flexible display unit 251 may transition to the second state such that the flexible display unit is deformed into the flat state (or a less curved state) or into a more curved state.

If desired, the flexible display unit 251 may implement a flexible touch screen using a touch sensor in combination with the display. When a touch is received at the flexible touch screen, the controller 180 can execute certain control corresponding to the touch input. In general, the flexible touch screen is configured to sense touch and other input while in both the first and second states.

One option is to configure the mobile terminal 200 to include a deformation sensor which senses the deforming of the flexible display unit 251. The deformation sensor may be included in a sensing unit 240 (refer to FIG. 2A).

The deformation sensor may be located in the flexible display unit 251 or a case 202 (refer to FIG. 2A) to sense information related to the deforming of the flexible display unit 251. Examples of such information related to the deforming of the flexible display unit 251 may be a deformed direction, a deformed degree, a deformed position, a deformed amount of time, an acceleration that the deformed flexible display unit 251 is restored, and the like. Other possibilities include most any type of information which can be sensed in response to the curving of the flexible display unit or sensed while the flexible display unit 251 is transitioning into, or existing in, the first and second states.

In some embodiments, the controller 180 or other component can change information displayed on the flexible display unit 251, or generate a control signal for controlling a function of the mobile terminal 200, based on the information related to the deforming of the flexible display unit 251. Such information is typically sensed by the deformation sensor.

Figure 2B:
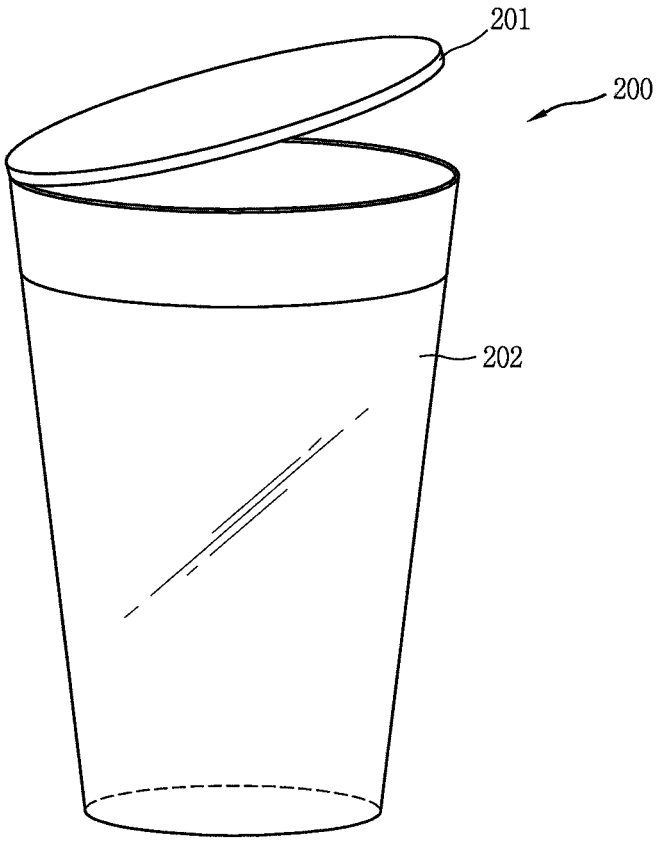
FIG. 2B is a conceptual view illustrating components of the smart cup.

The mobile terminal 200 in FIG. 2B is shown having a case 202 for accommodating the flexible display unit 251.

The case 202 can be deformable together with the flexible display unit 251, taking into account the characteristics of the flexible display unit 251.

A battery (not shown in this figure) located in the mobile terminal 200 may also be deformable in cooperation with the flexible display unit 251, taking into account the characteristic of the flexible display unit 251. One technique to implement such a battery is to use a stack and folding method of stacking battery cells.

The deformation of the flexible display unit 251 not limited to perform by an external force. For example, the flexible display unit 251 can be deformed into the second state from the first state by a user command, application command, or the like.

A mobile terminal according to an embodiment of the present disclosure may include a function as a container capable of containing a drinking substance. The mobile terminal may be called as a 'smart cup,' 'smart tumbler,' or 'active smart tumbler.' Hereinafter, the mobile terminal will be described as the term 'smart cup.' However, the present disclosure is not limited thereto, and may be applied to all mobile terminals similar thereto.

A smart cup according to an embodiment of the present disclosure may provide a user with various functions by using motions of the smart cup. Also, the smart cup may provide the user with additional information using a drinking substance contained in the smart cup, based on information on a kind of the drinking substance, a capacity of the drinking substance, a component constituting the drinking substance, etc.

Hereinafter, components of a smart cup according to an embodiment of the present disclosure will be described. FIG. 2A is a block diagram illustrating components of a smart cup according to an embodiment of the present disclosure, and FIG. 2B is a conceptual view illustrating components of the smart cup.

The smart cup 200 according to the embodiment of the present disclosure may include at least one of the components described in FIG. 1. Particularly, referring to FIG. 2A, the smart cup 200 may include at least one a wireless communication unit 210, a driving unit 230, a sensing unit 240, an output unit 250, and a controller 280. In the following description, the components of FIG. 2A will be mainly described, and additional or supplementary description is replaced with that of FIG. 1.

The wireless communication unit 210 may include at least one module that enables wireless communication between the smart cup 200 and a wireless communication system, between the smart cup 200 and the other smart cup, or between the smart cup 200 and an external server. Also, the wireless communication unit 210 may include one or more modules for connecting the smart cup to one or more networks. Detailed description of the wireless communication unit 210 is replaced with the contents described in FIG. 1.

The driving unit 230 may apply an electromagnetic force or a mechanical physical force so as to drive the components of the smart cup 200. As an example, the driving unit 230 may include a coil magnet, and may move a cover 201 by using an electromagnetic force generated by the coil magnet. As another example, the driving unit 230 may include a motor such that the cover 201 performs translation and rotation motions.

The sensing unit 240 may sense at least one of information on the inside of the smart cup 200 and information on the outside of the smart cup 200, and generate sensing signals corresponding to the information. The sensing unit 240 may include at least one sensor.

More specifically, referring to FIG. 2A, the sensing unit 240 may include a proximity sensor 241, a drinking substance sensing unit 242, and a motion sensing unit 243.

The proximity sensor 241 may sense an object located in an area contacted with or adjacent to one side of a main body or case 202 of the smart cup 200. For example, the proximity sensor 241 may sense user's lips located in an area contacted with or adjacent to an opening of the smart cup 200.

The drinking substance sensing unit 242 may sense information related to a drinking substance contained in an internal space of the main body 202, including an amount of the drinking substance, a kind (or manufacturer) of the drinking substance, a temperature of the drinking substance, a component of the drinking substance, properties of the component, and the like.

More specifically, the drinking substance sensing unit 242 may include optical sensors or capacitance sensors so as to sense a capacity of the drinking substance. The optical sensors or capacitance sensors may be disposed to be spaced apart from each other along a wall of the internal space of the main body 202.

Also, the drinking substance sensing unit 242 may further include a spectral sensor to acquire the intrinsic spectrum of a drinking substance. The controller 280 may analyze at least one of a kind of the drinking substance, a manufacturer of the drinking substance, a component of the drinking substance, a concentration of the component, and a calorie of the component.

Also the drinking substance sensing unit 242 may include a thermistor to sense a temperature of a drinking substance. The drinking substance sensing unit 242 may include one or more temperature sensors. The temperature sensors may be provided at a lower side of the main body 202, and disposed to be spaced apart from each other along the wall of the internal space of the main body 202.

The motion sensing unit 243 may sense a motion of the main body 202. The motion of the main body 202 may be sensed by a motion speed of the main body 202, a motion acceleration of the main body 202, a rotation speed of the main body 202, a rotational acceleration of the main body 202, a rotational angle (or inclination) of the main body 202, and the like.

The motion sensing unit 243 may include an acceleration sensor, a gravity sensor, a gyroscope sensor, etc. so as to sense a motion of the main body 202.

The output unit 250 may output information related to the smart cup 200 in visual, auditory, and haptic ways such that a user can recognize the information. The output unit 250 may include a display unit 251, a sound output unit, and a haptic output unit.

The display unit 251 may visually output information related to the smart cup 200. The display unit 251 may further include touch sensors, to sense a touch applied to the display unit 251 through a user's finger. The touch sensors may be disposed while forming a layer structure at a lower portion of the display unit 251.

The controller 280 may control the above-described components, thereby executing functions in the smart cup 200. For example, the controller 280 may output, on the display unit 251, information generated based on sensor signals sensed by the sensing unit 240.

In the above, the components of the smart cup 200 according to the embodiment of the present disclosure have been described. Hereinafter, a structure of the smart cup 200 according to the embodiment of the present disclosure will be described with reference to FIG. 2B.

Referring to FIG. 2B, the smart cup according to the embodiment of the present disclosure may include a main body 202 formed to contain a drinking substance, a cover 201 formed to an opening of the main body 202, and a display unit 251 formed to surround at least one portion of the main body 202.

The main body 202 may include an internal space in which a drinking substance is contained and an outside surrounding the internal space. One side of the main body 202 may include an opening having a structure in which the internal space is opened to the outside such that a drinking substance can enter/exit therethrough.

The main body 202 may be made of a material such as plastic, glass or synthetic resin. The main body 202 may have various shapes such that a user can hold the main body 202.

The cover 201 may be formed to cover at least one portion of the opening so as to prevent a drinking substance contained in the internal space of the main body 202 from being discharged to the outside. The cover 201 may be formed to be attachable/detachable to/from the main body 202. For example, a groove may be formed in each of the cover 201 and the main body 202 such that the cover 201 is attachable/detachable to/from the main body 202.

Also, the cover 201 may cover at least one portion of the opening by an external force or electromagnetic force applied from the user. More specifically, the cover 201 may be slidingly moved or rotatably moved by the external force or electromagnetic force applied from the user, thereby covering at least one portion of the opening. When the cover 201 covers the opening, it is possible to prevent a drinking substance contained in the internal space of the main body 202 from being discharged to the outside. The cover 201 may be called as a stopper, a lid, or the like.

The display unit 251 may be formed to surround at least one portion of the main body 202. The display unit 251 may be implemented as a flexible display that is warped, rolled, and wound. For example, referring to FIG. 2B, the display unit 251 may be a flexible display formed to surround the cylindrical main body 202.

Also, the display unit 251 may further include touch sensors to sense a user's touch applied thereto.

Hereinafter, a case where the display unit 251 covers the entire outside of the main body will be described. However, the present disclosure is not limited thereto, and may be identically applied to a case where the display unit 251 covers a portion of the main body.

Figure 3:
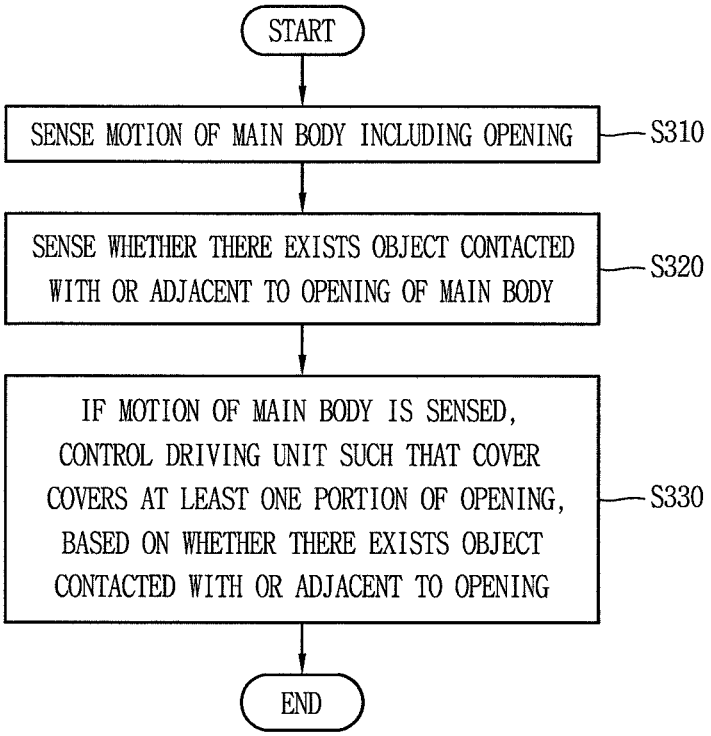
FIG. 3 is a flowchart illustrating a control method of the smart cup.
Figure 4A:
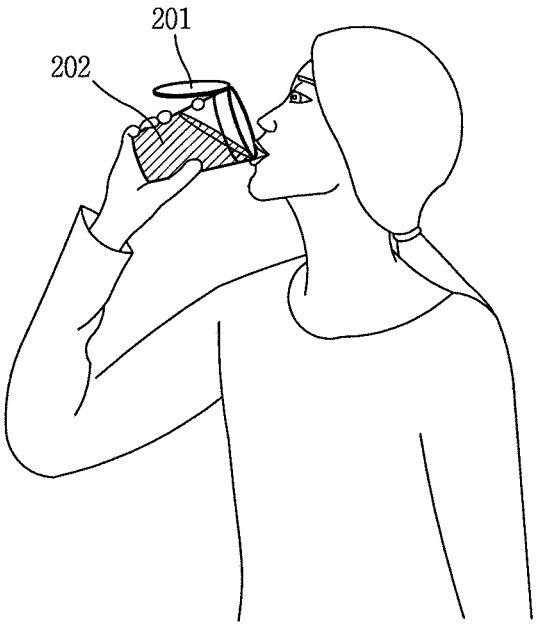
FIGS. 4A and 4B are conceptual views illustrating the control method of FIG. 3.
Figure 4B:
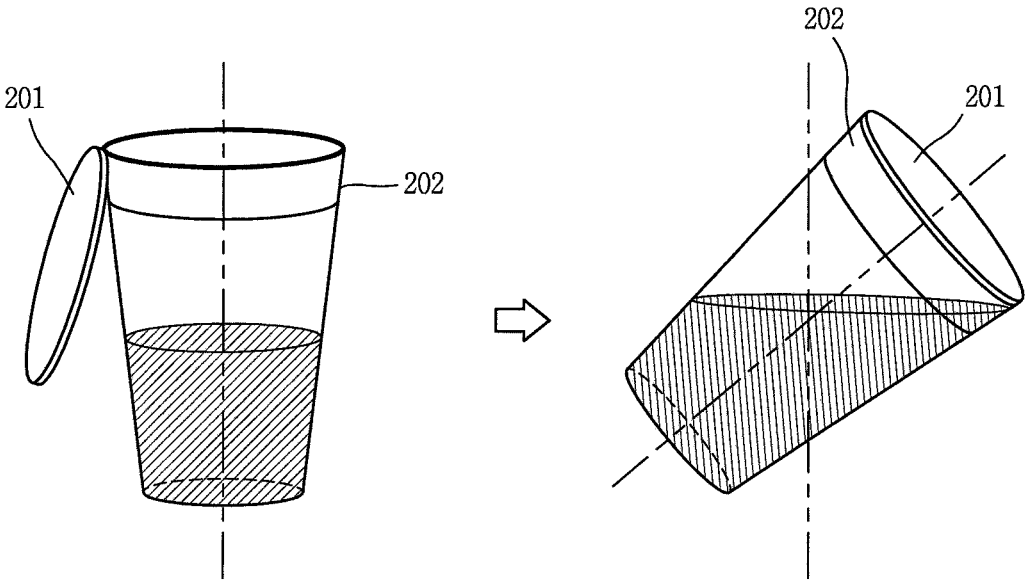

In the above, the structure of the smart cup 200 according to the embodiment of the present disclosure has been described. Hereinafter, a control method of the smart cup described in FIGS. 2A and 2B will be described. FIG. 3 is a flowchart illustrating a control method of the smart cup according to the embodiment of the present disclosure. FIGS. 4A and 4B are conceptual views illustrating the control method of FIG. 3.

First, the smart cup according to the embodiment of the present disclosure may sense a motion of the main body including the opening (S310).

The smart cup according to the embodiment of the present disclosure may sense a motion of the main body 202 moved by an external force applied from the outside through the motion sensing unit 243 (see FIG. 2A).

The motion of the main body 202 may include a rectilinear motion of the main body and a rotary motion of the main body. The motion of the main body 202 may be sensed by a motion speed, a motion acceleration, a rotation speed, a rotational acceleration, a rotational angle, and the like. For example, the controller 280 may sense a rotary motion of the main body by measuring a rotational angle, based on a reference line in the gravitational direction.

If a motion of the main body 202 is sensed, the controller 280 may decide whether the motion of the main body 202 corresponds to a predetermined motion. The predetermined motion may be a motion previously stored in a memory of the smart cup 200.

When the motion of the main body 202 does not correspond to the predetermined motion, the controller 280 may neglect or delete a sensing signal corresponding to the motion of the main body 202, which is sensed through the motion sensing unit 243, such that the smart cup 200 does not execute any function. Thus, in the present disclosure, although an unintended motion is generated by a user, it is possible to permit an error of a certain level according to the motion.

When the motion of the main body 202 corresponds to the predetermined motion, the smart cup according to the embodiment of the present disclosure may sense an object contacted with or adjacent to the opening of the main body 202 (S320).

When the motion of the main body 202 corresponds to the predetermined motion, the controller 280 may sense, through the proximity sensor 241, whether there exists an object contacted with or adjacent to the opening of the main body 202.

The object contacted with or adjacent to the opening of the main body 202 may be a user's mouth or an auxiliary tool for assisting the user to drink a drinking substance. For example, the auxiliary tool may be a drinking straw.

As an example, as shown in FIG. 4A, the controller 280 may sense that the user's mouth has been contacted with the opening of the main body 202.

Meanwhile, steps S310 and S320 may be sequentially performed in the above-described order, or the order of steps S310 and S320 may be changed. Alternatively, steps S310 and S320 may be performed at the same time.

The smart cup according to the embodiment of the present disclosure may control the driving unit 230 such that the cover 201 covers at least one portion of the opening of the main body 202, based on whether there exists an object contacted with or adjacent to the opening (S330).

When there exists an object contacted with or adjacent to the opening of the main body 202, the controller 280 may decide the motion of the main body 202 as a motion made to drink a drinking substance contained in the internal space of the main body 202.

In this case, the controller 280 may determine a state of the cover 201, based on a relative position between the cover 201 and the opening of the main body 202. The state of the cover 201 is any one of a first state in which the cover 201 covers at least one portion of the opening and a second state in which the cover 201 does not cover the opening.

When the state of the cover 201 is the first state in which the cover 201 covers at least one portion of the opening, the controller 280 may control the driving unit 230 such that the cover 201 does not cover the opening, thereby changing the state of the cover 201 from the first state to the second state.

When the state of the cover 201 is the second state in which the cover 201 does not cover the opening, the controller 280 may not control the driving unit 230.

That is, when it is decided that the motion of the main body 202 is a motion made to drink the drinking substance contained in the internal space of the main body 202, the controller 280 may control the cover 201 and the driving unit 230 such that the cover 201 does not cover the opening of the main body 202. For example, as shown in FIG. 4A, when the user's mouth is contacted with the opening of the main body 202, the controller 280 may control the cover 201 and the driving unit 230 such that the cover 201 does not cover the opening of the main body 202.

On the contrary, when there exists no object contacted with or adjacent to the opening of the main body 202, the controller 280 may determine the motion of the main body 202 as a motion where the user does not drink the drinking substance.

In this case, the controller 280 may detect a state of the cover 201 such that the state of the cover 201 becomes the first state in which the cover 201 covers at least one portion of the opening.

When the state of the cover 201 is the second state in which the cover 201 does not cover the opening, the controller 280 may control the driving unit 230 such that the cover 201 covers at least one portion of the opening.

When the state of the cover 201 is the first state in which the cover 201 covers at least one portion of the opening, the controller 280 may control the driving unit 230 to maintain the state of the cover 201.

That is, when the motion of the main body 202 is not the motion made to drink the drinking substance contained in the internal space of the main body 202, the controller 280 may control the opening to be covered by the cover 201 such that the drinking substance is not discharged to the outside.

For example, as shown in FIG. 4B, when the motion of the main body 202 is not the motion made to drink the drinking substance contained in the internal space of the main body 202, the controller 280 may control the driving unit 230 such that the cover 201 covers the opening. Thus, the user can tilt the main body 202 without discharging the drinking substance to the outside.

Also, the controller 280 may control the motion speed of the cover 201, caused by the driving unit 230, based on information related to the drinking substance contained in the internal space of the main body 202.

For example, the controller 280 may determine a motion speed of the cover 201, caused by the driving unit 230, based on a capacity of the drinking substance contained in the internal space of the main body 202. More specifically, the controller 280 may detect a capacity of the drinking substance through the drinking substance sensing unit 242.

After that, the controller 280 may control the motion speed of the cover 201 to become faster as the capacity of the drinking substance becomes larger. For example, when the capacity of the drinking substance is a first capacity, the controller 280 may control the motion speed of the cover 201 such that the cover 201 moves at a first speed. When the capacity of the drinking substance is a second capacity greater than the first capacity, the controller 280 may control the motion speed of the cover 201 such that the cover 201 moves at a second speed faster than the first speed.

Meanwhile, when it is decided that the motion of the main body 202 corresponds to a predetermined motion, and is not the motion made to drink the drinking substance contained in the internal space of the main body 202, the controller 280 may execute a function mapped to the motion of the main body 202.

The function mapped to the motion of the main body 202 may be a function executable in the smart cup 200. For example, the function mapped to the motion of the main body 202 may be a drinking substance discharge function, a data transmission function, etc.

More specifically, when the motion of the main body 202 corresponds to the predetermined motion, and there exists no object contacted with or adjacent to the opening of the main body 202, the controller 280 may execute the function mapped to the motion of the main body 202, based on an area in which a touch is sensed on the display unit 251. For example, the controller 280 may execute a first function, based on that a touch is applied to the first area on the display unit 251. The controller 280 may execute a second function, based on that a touch is applied to a second area on the display unit 251.

Also, the controller 280 may display additional information on the display unit 251, based on information related to the drinking substance. For example, the additional information may be preparation information related to the drinking substance, capacity information of the drinking substance, etc.

Also, the controller 280 may divide the display unit 251 into a plurality of areas and display different information in the respective areas, based on the information related to the drinking substance. For example, the controller 280 may display the information related to the drinking substance in an area corresponding to the capacity of the drinking substance and display information related to music replay in the other area, based on the capacity information of the drinking substance.

Also, the controller 280 may display, on the display unit 251, information related to at least one of place information and time information of the smart cup 200, based on at least one of the place information and the time information. For example, when the smart cup 200 is located at a specific place, the controller 280 may display, on the display unit 251, information related to the specific place.

In the above, the method of executing various functions by using motions of the smart cup has been described. Thus, the user can use not only a function of containing a drinking substance by using the smart cup but also various functions.

Figure 5A:
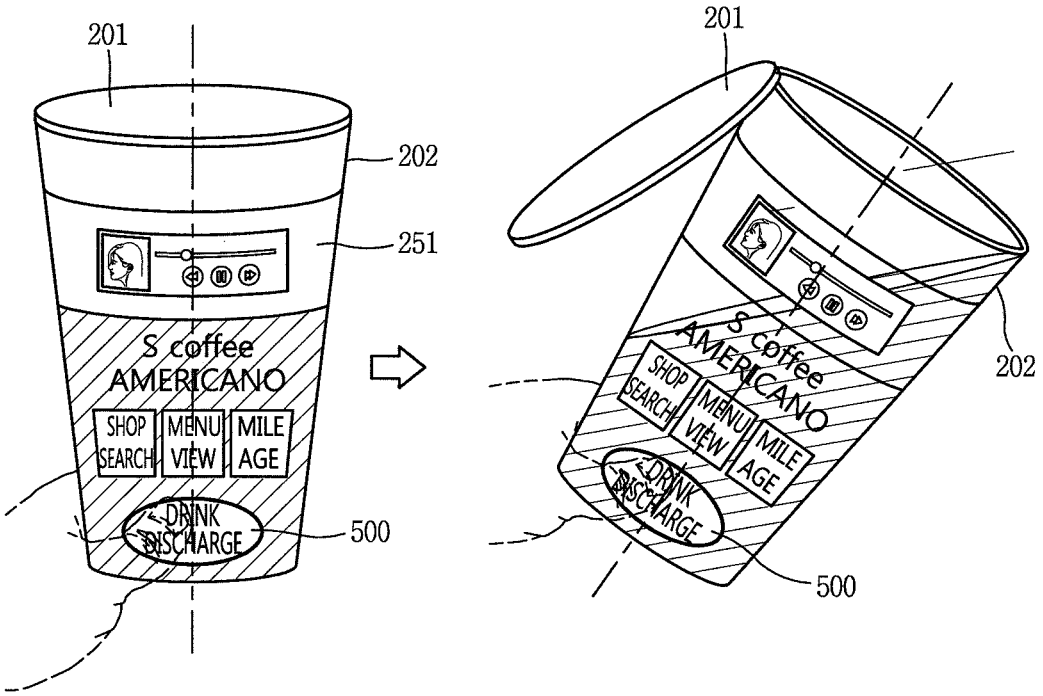
FIGS. 5A to 5C are conceptual views illustrating a method of executing a function mapped to a motion of a main body, when the motion of the main body is not a motion made to drink a drinking substance.
Figure 5B:
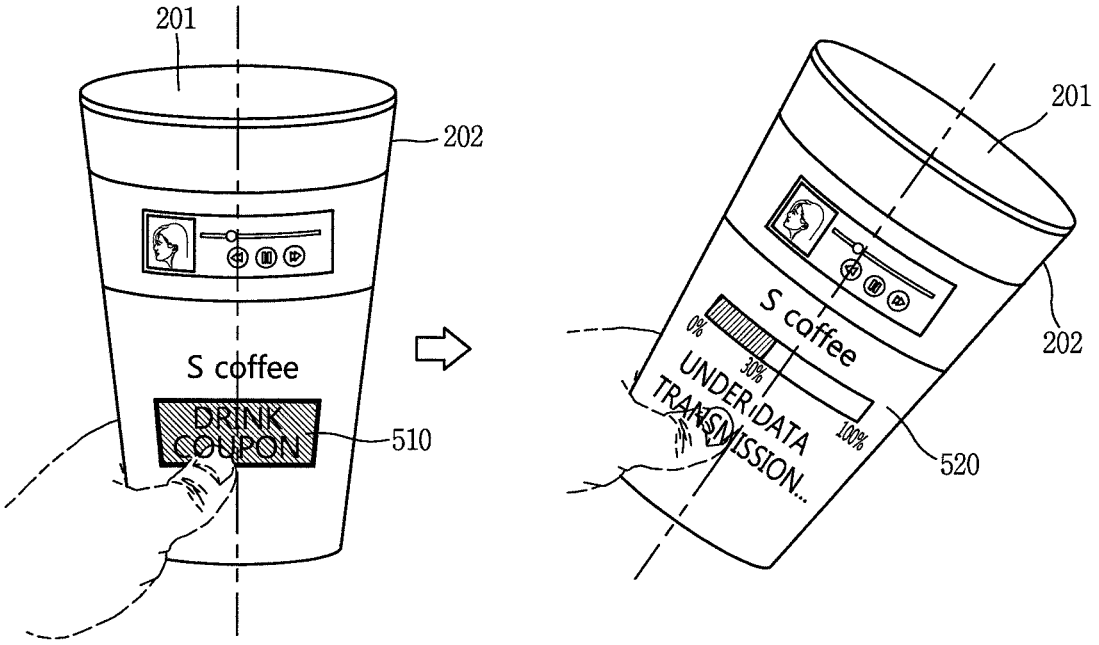
Figure 5C:
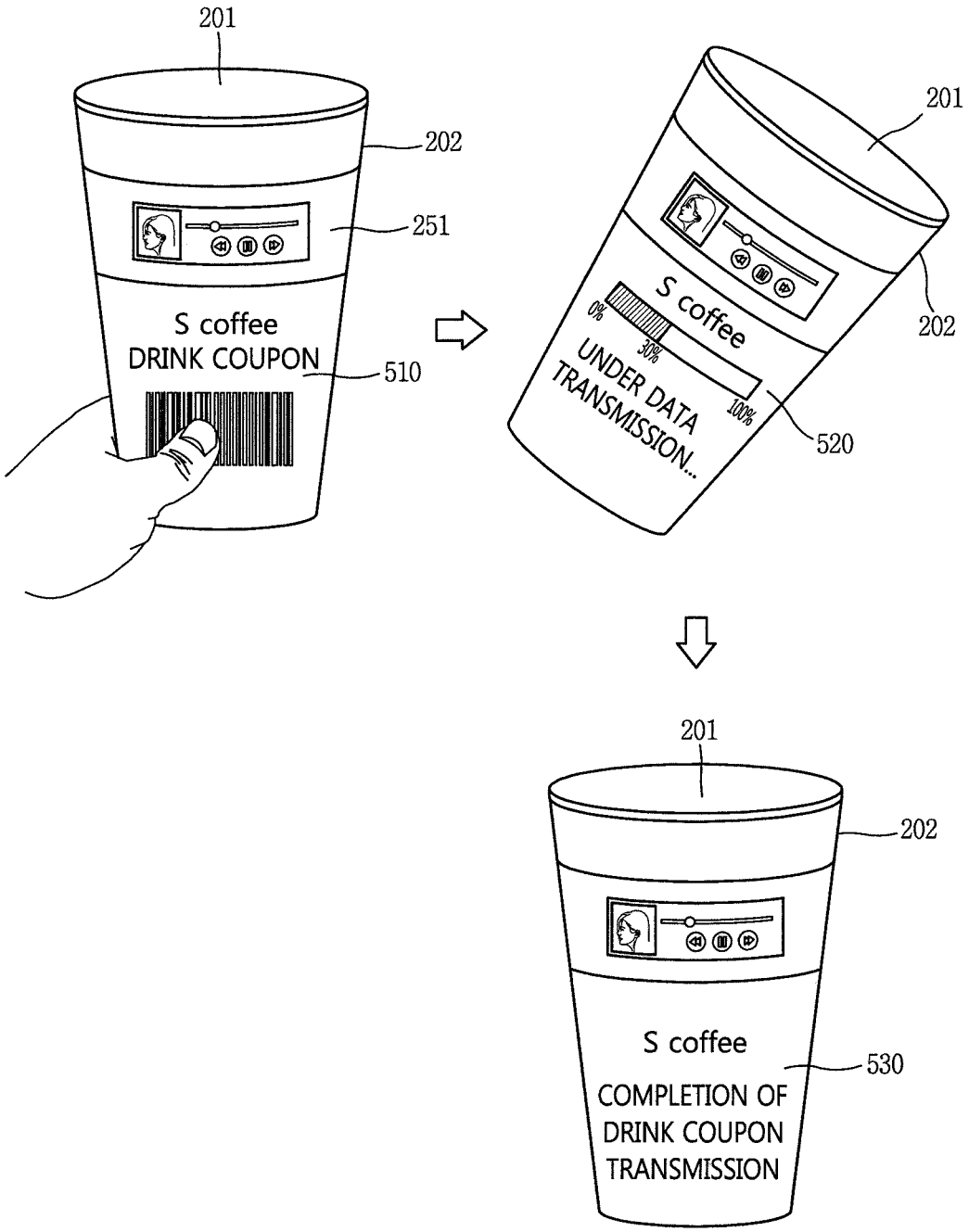

Hereinafter, a method of executing a function mapped to a motion of the main body, when the motion of the main body is not a motion made to drink a drinking substance, will be described. FIGS. 5A to 5C are conceptual views illustrating a method of executing a function mapped to a motion of the main body, when the motion of the main body is not a motion made to drink a drinking substance.

In the smart cup 200 according to the embodiment of the present disclosure, if a motion of the main body 202 is sensed as described above, the controller 280 may decide whether the motion of the main body 202 corresponds to a predetermined motion.

When the motion of the main body 202 corresponds to the predetermined motion, and there exists no object contacted with or adjacent to the opening, the controller 280 may execute any one function among function mapped to the motion of the main body 202.

The functions mapped to the motion of the main body 202 may be set by a user or set when the smart cup 200 is delivered from a factory.

The functions mapped to the motion of the main body 202 may be a function related to an operation of the smart cup 200, a function related to an application installed in the smart cup 200, and the like. The function related to the operation of the smart cup 200 may be a function of releasing a locking state, a function of turning on/off power, a function of turning on/off the display unit 251, etc.

The application installed in the smart cup 200 may be downloaded from an external server to be installed, or may be installed when the smart cup 200 is delivered from the factory, according to a user's request.

For example, the functions mapped to the motion of the main body 202 may be a data transmission function of transmitting data to an external device, a drinking substance discharge function, and the like.

Meanwhile, when the motion of the main body 202 corresponds to the predetermined motion, and there exists no object contacted with or adjacent to the opening, the controller 280 may execute a specific function among the functions mapped to the motion of the main body 202, based on an area to which a touch is applied on the display unit 251. That is, when it is decided that the motion of the main body 202 is not the motion made to drink the drinking substance, the controller 280 may execute a specific function.

As an example, as shown in a first drawing of FIG. 5A, a graphic object 500 related to a drinking substance discharge function may be displayed on the display unit 251.

In this case, when a touch is sensed on an area in which the graphic object 500 related to the drinking substance discharge function is displayed, and the motion of the main body 202 corresponds to the predetermined motion, the controller 280 may control the cover 201 such that a drinking substance contained in the internal space of the main body 202 is discharged to the outside. For example, as shown in a second drawing of FIG. 5A, when the state of the cover 201 is the first state in which the cover 201 covers at least one portion of the opening of the main body 202, the controller 280 may control the driving unit 230 such that the state of the cover 201 becomes the second state in which the cover 201 does not cover the opening of the main body 202. Thus, the user can discharge, to the outside, the drinking substance contained in the internal space of the main body 202.

As another example, when a touch is sensed in an area in which specific information among a plurality of information displayed on the display unit 251 is displayed, and the motion of the main body 202 corresponds to the predetermined motion, the controller 280 may transmit the specific information to an external device through wireless communication. The specific information may be information related to a function executed in the smart cup 200 or information related to the drinking substance. For example, the specific information may be drink coupon information. The drink coupon information may also be called as gifticon.

Here, the external device to receive the specific information may be an external device capable of performing near-field communication (NFC) with the smart cup 200. For example, the external device may be an external device connected through any one of Bluetooth communication and NFC communication.

Alternatively, the external device may be an external device located in an area physically contacted with or adjacent to the main body 202 of the smart cup 200. For example, the external device may be an external device being physically contacted with at least one portion of the main body 202 of the smart cup 200.

For example, as shown in a first drawing of FIG. 5B, when a touch is sensed on an area in which drink coupon information 510 is displayed, and the motion of the main body 202 corresponds to the predetermined motion, the controller 280 may transmit the drink coupon information 510 to an external device through wireless communication.

When specific information is transmitted, the controller 280 may display, on the display unit 251, information related to a transmission status of the specific information. The information related to the transmission status of the specific information may be a progress bar indicating a transmission degree.

For example, as shown in a second drawing of FIG. 5B, a progress bar 520 indicating a transmission degree of the drink coupon information may be displayed on the display unit 251.

If the transmission of the drink coupon information 510 is completed, the controller 280 may display completion information on the display unit 251. As sequentially shown in first, second, and third drawings of FIG. 5C, the controller 280 may sequentially display transmission status information according to the elapse of time. For example, as shown in the third drawing of FIG. 5C, if the transmission of the drink coupon information 510 is completed, the controller 280 may display completion information 530 on the display unit 251.

Thus, the user can recognize that the drink coupon information 510 has been successfully transmitted.

In the above, the method of executing a function mapped to the motion of the main body when the motion of the main body is not the motion made to drink the drinking substance has been described. Thus, the user can conveniently perform not only a function for drinking a drinking substance, which is an essential function of the smart cup, but also additional functions except the function for drinking the drinking substance.

Figure 6A:
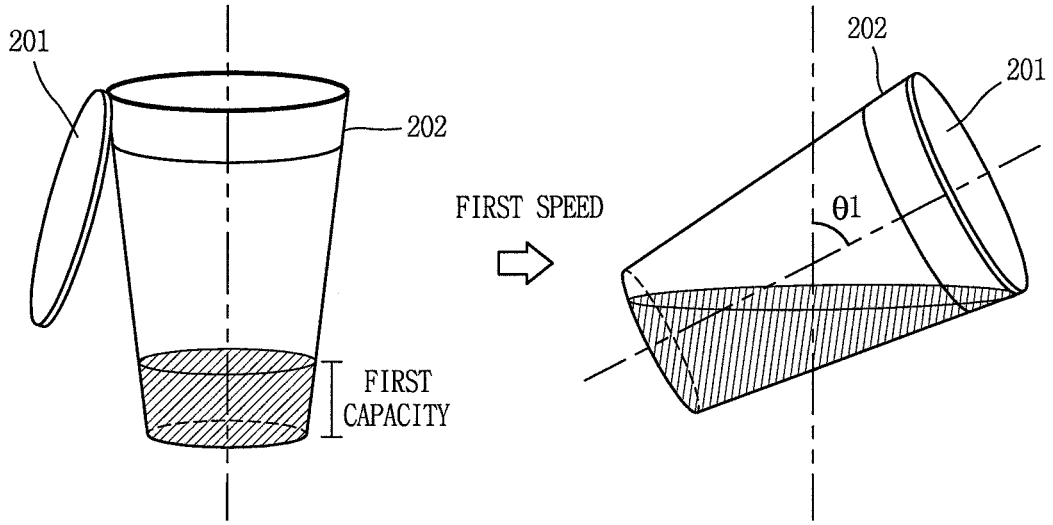
FIGS. 6A and 6B are conceptual views illustrating a method of controlling a cover for covering a portion of an opening of the main body, when a motion of the main body does not correspond to a function of drinking a drinking substance.
Figure 6B:
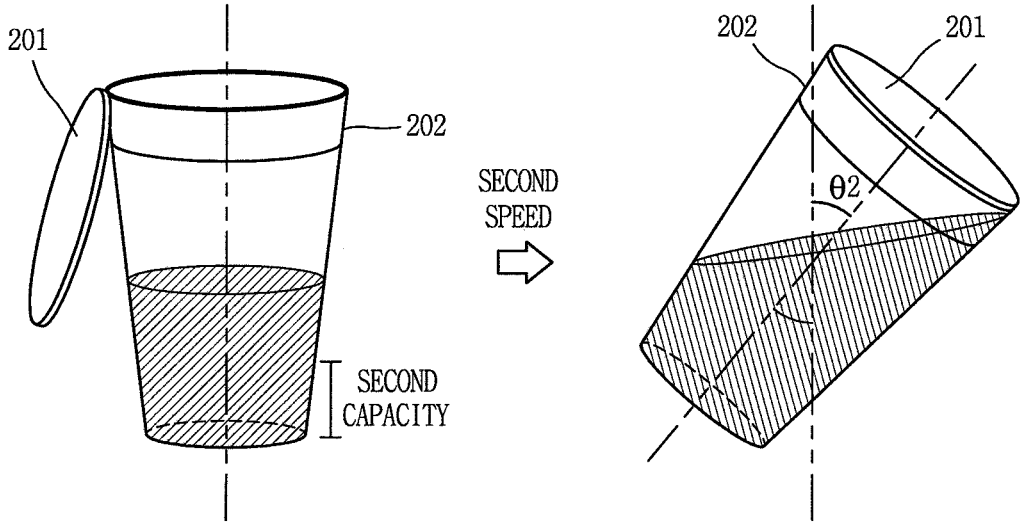

Hereinafter, a method of controlling the cover for covering a portion of the opening of the main body, when a motion of the main body does not corresponds to a function for drinking a drinking substance, will be described. FIGS. 6A and 6B are conceptual views illustrating a method of controlling the cover for covering a portion of the opening of the main body, when a motion of the main body does not correspond to a function of drinking a drinking substance.

In the smart cup 200 according to the embodiment of the present disclosure, when the motion of the main body 202 is not the motion made to drink a drinking substance, the controller 280 may control the cover 201 through the driving unit 230 to cover at least one portion of the opening of the main body 202 such that the drinking substance contained in the internal space of the main body 202 is not discharged to the outside.

In this case, the controller 280 may control the motion speed of the cover 201, based on information related to the drinking substance sensed by the drinking substance sensing unit 243.

More specifically, if the capacity of the drinking substance contained in the internal space of the main body 202 is large, the discharge speed of the drinking substance, caused by the motion of the main body 202, is increased, and hence the controller 280 may increase the motion speed of the cover 201. If the capacity of the drinking substance contained in the internal space of the main body 202 is small, the discharge speed of the drinking substance, caused by the motion of the main body 202, is decreased, and hence the controller 280 may decrease the motion speed of the cover 201.

As an example, as shown in a first drawing of FIG. 6A, the controller 280 may sense that the capacity of the drinking substance is a first capacity.

In this case, as shown in a second drawing of FIG. 6A, the controller 280 may move the cover 201 at a first speed corresponding to the first capacity through the driving unit 230.

More specifically, when the capacity of the drinking substance corresponds to the first capacity, the controller 280 may calculate, as a first angle θ1, a rotational angle of the main body 202, at which the drinking substance is discharged to the outside. In this case, the controller 280 may set the motion speed of the cover 210 as a first speed such that the cover 201 can cover the opening before the main body 202 is rotated at the first angle.

As another example, as shown in a first drawing of FIG. 6B, the controller 280 may sense that the capacity of the drinking substance is a second capacity greater than the first capacity.

In this case, as shown in a second drawing of FIG. 6B, the controller 280 may move the cover 201 at a second speed corresponding to the second capacity.

More specifically, when the capacity of the drinking substance corresponds to the second capacity, the controller 280 may calculate, as a second angle θ2, a rotational angle of the main body 202, at which the drinking substance is discharged to the outside. In this case, the controller 280 may set the motion speed of the cover 210 as a second speed such that the cover 201 can cover the opening before the main body 202 is rotated at the second angle.

That is, in the present disclosure, the motion speed of the cover is appropriately controlled according to the capacity of the drinking substance, so that it is possible to prevent the drinking substance from being discharged to the outside.

In the above, the method of controlling the cover for covering a portion of the opening of the main body, when the motion of the main body does not correspond to the function for drinking the drinking substance, has been described. Accordingly, when a user uses the smart cup having a drinking substance contained in the internal space thereof, the user can use various functions while preventing the drinking substance from being discharged to the outside.

Figure 7:
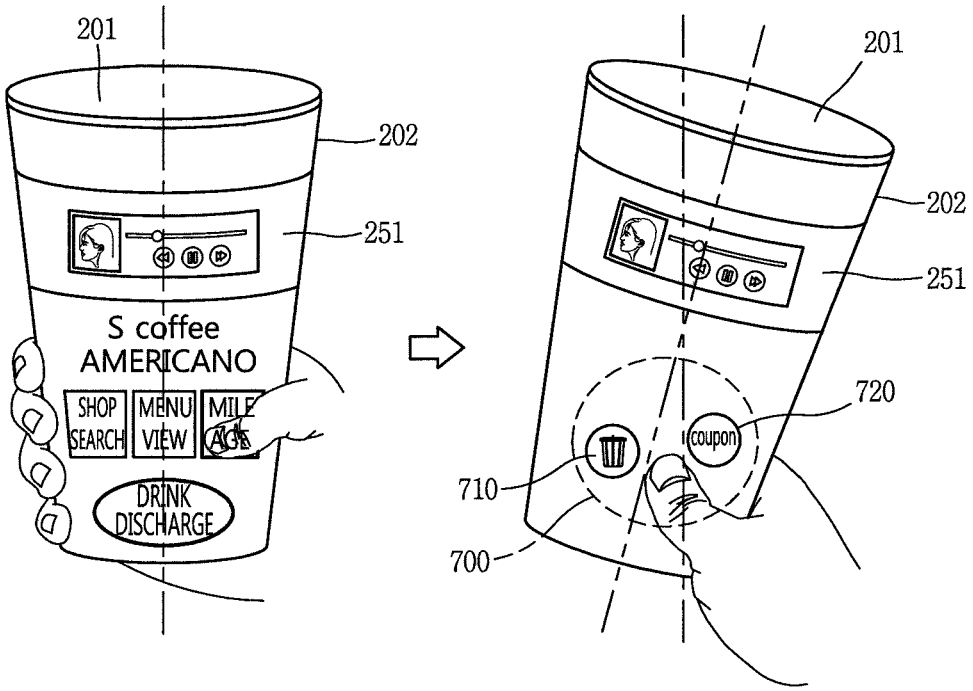
FIG. 7 is a conceptual view illustrating a method of displaying, on a user's fingering area, icons of executable functions through the smart cup, when a motion of the main body does not correspond to a function of drinking a drinking substance.

Hereinafter, a method of displaying, on a user's fingering area, icons of functions executable through the smart cup 200, when a motion of the main body does not correspond to a function for drinking a drinking substance, will be described. FIG. 7 is a conceptual view illustrating a method of displaying, on a user's fingering area, icons of executable functions through the smart cup, when a motion of the main body does not correspond to a function of drinking a drinking substance.

In the smart cup 200 according to the embodiment of the present disclosure, when the motion of the main body 202 does not correspond to the function for drinking the drinking substance, the controller 280 may display, on a user's fingering area, a function list including items corresponding to the functions executable through the smart cup 200.

The functions corresponding to the items included in the function list may be frequently used functions or functions previously set by the user.

When the functions corresponding to the items included in the function list are frequently used functions, the functions included in the function list may be changed as the user's use pattern is changed.

Alternatively, the functions corresponding to the items included in the function list may be functions related to a function being currently executed in the smart cup 200. For example, when a web browsing function is executed in the smart cup 200, the function related to the currently executed function may be a URL sharing function, a web page capturing function, a web page downloading function, etc.

The controller 280 may display the function list on a user's fingering area. The fingering area may be an area which a specific finger of the user can reach on the display unit 251.

The controller 280 may set the fingering area within a predetermined radius about an area in which a touch is currently sensed on the display unit 251. For example, as shown in a second drawing of FIG. 7, the controller 280 may set, as the fingering area, an area 700 within a predetermined radius about an area in which a touch is applied by a user's thumb. Thus, the user can easily execute functions while maintaining a state in which the user holds the smart cup 200.

For example, as shown in a first drawing of FIG. 7, the controller 280 may control the smart cup 200 to be rotated in a state in which the smart cup 200 is held by a user's hand.

In this case, as shown in the second drawing of FIG. 7, the controller 280 may detect a fingering area 700 about an area reached by the thumb on the display unit 251. Also, the controller 280 may display, in the fingering area 700, icons 710 and 720 corresponding to items included in the function list. The icons corresponding to the items included in the function list may be an icon 710 related to the drink discharge function and an icon 720 related to the data transmission function.

Thus, the user can conveniently execute functions by using only the thumb, without changing the state in which the user holds the smart cup 200.

In the above, the method of displaying, on the user's fingering area, icons of functions executable through the smart cup 200, when the motion of the main body does not correspond to the function for drinking the drinking substance, has been described.

Figure 8A:
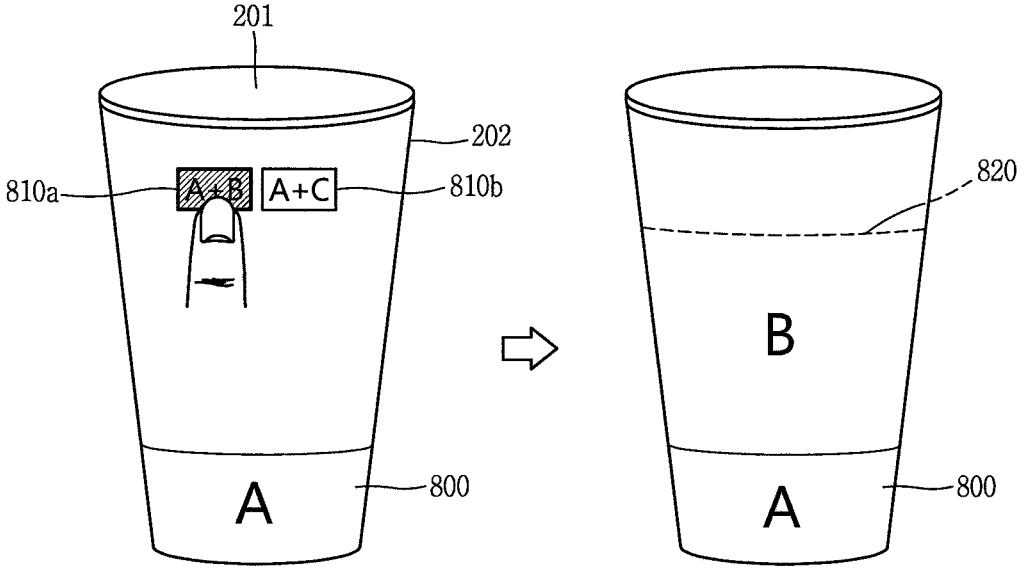
FIGS. 8A and 8B are conceptual views illustrating a method of providing additional information, based on information related to a drinking substance contained in the smart cup.
Figure 8B:
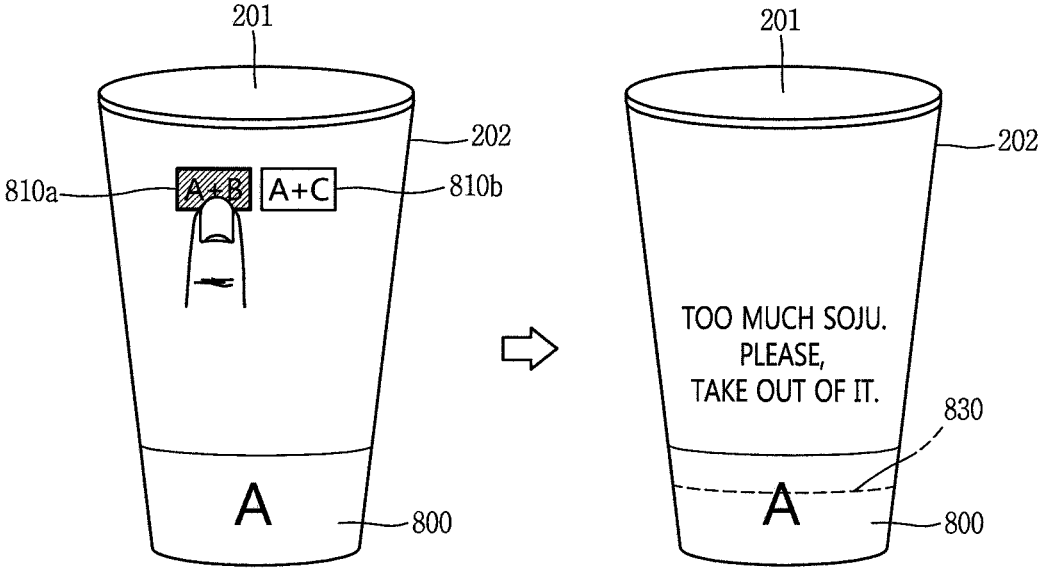

Hereinafter, a method of providing additional information, based on information related to a drinking substance contained in the smart cup will be described. FIGS. 8A and 8B are conceptual views illustrating a method of providing additional information, based on information related to a drinking substance contained in the smart cup.

The smart cup 200 according to the embodiment of the present disclosure may extract information related to a drinking substance contained in the internal space of the main body 202 through the drinking substance sensing unit 242.

The information related to the drinking substance may be a capacity of the drinking substance, a kind of the drinking substance, a manufacturer of the drinking substance, a component of the drinking substance, component analysis information (a main component, a concentration, a calorie, etc.), a temperature of the drinking substance, etc.

If the information related to the drinking substance is extracted, the controller 280 may generate additional information or detect the additional information in the memory 170, based on the information related to the drinking substance. Here, the additional information may be recipe information related to the drinking substance. The recipe information related to the drinking substance may include ingredient information, ingredient amount information, etc.

For example, as shown in a first drawing of FIG. 8A, when a drinking substance called A 800 is extracted, the controller 280 may detect cocktail recipe information of A+B using the drinking substance A (800) and a cocktail ingredient B or cocktail recipe information A+C using the drinking substance A (800) and a cocktail ingredient C. In this case, graphic objects 810*a* and 810*b* respectively related to A+B and A+C may be displayed on the display unit 251.

When recipe information related to the drinking substance is selected based on a user's request, the controller 280 may display, on the display unit 251, the recipe information related to the drinking substance. For example, as shown in a second drawing of FIG. 8A, when the cocktail recipe information of A+B is selected, the controller 280 may display guide information 820 in an area corresponding to the capacity of A 800 and B on the display unit 251.

When the capacity of the drinking substance called A 800 is currently large, as shown in first and second drawings of FIG. 8B, the controller 280 may display, on the display unit 251, guide information 830 for reducing the capacity of the drinking substance called A.

In the above, the method of providing additional information, based on the information related to the drinking substance, has been described. Accordingly, the user can more intuitively recognize recipe information.

Figure 9A:
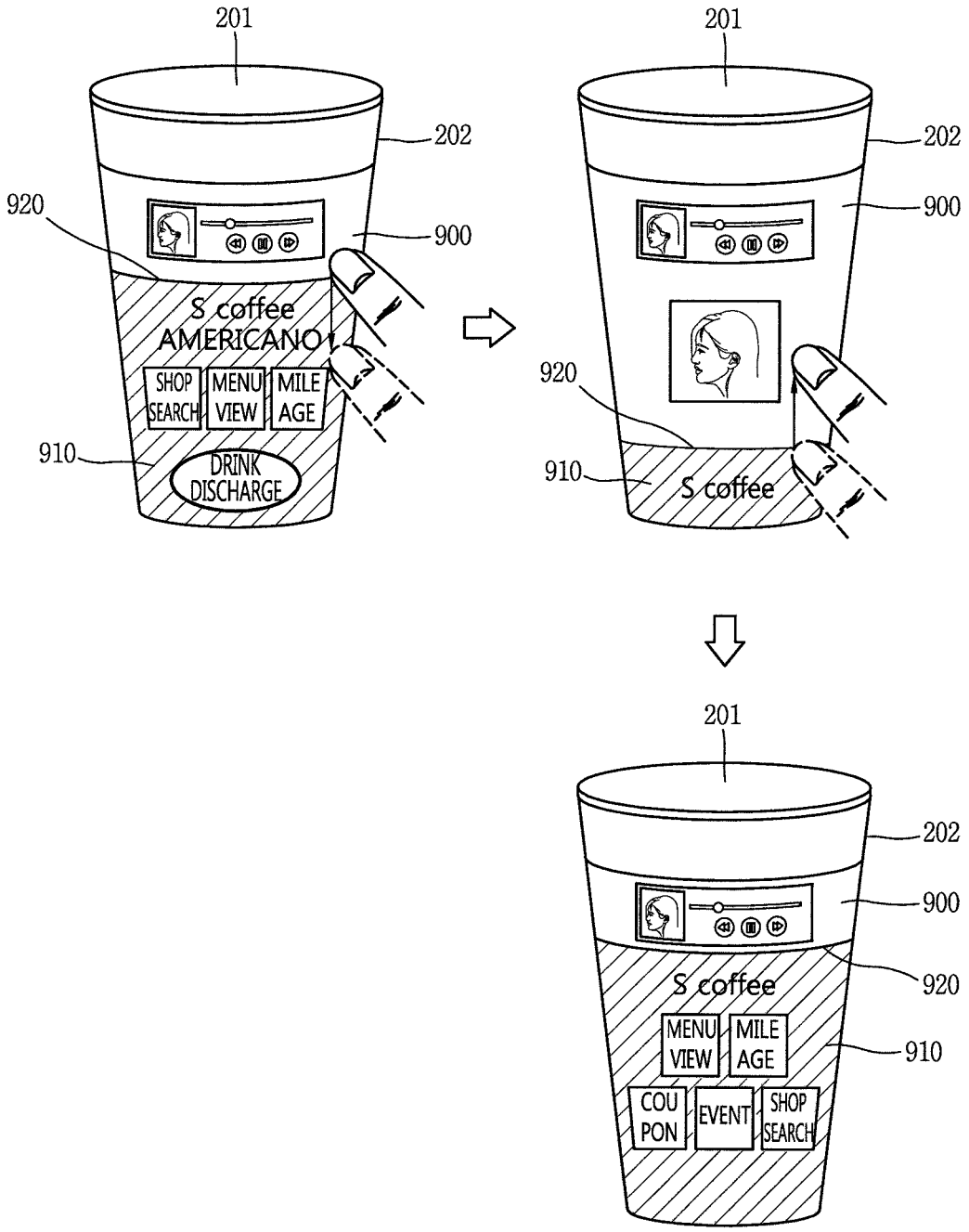
FIGS. 9A and 9B are conceptual views illustrating a method of controlling a display area of a display unit, based on a user's control command, in the smart cup according to the embodiment of the present disclosure.
Figure 9B:
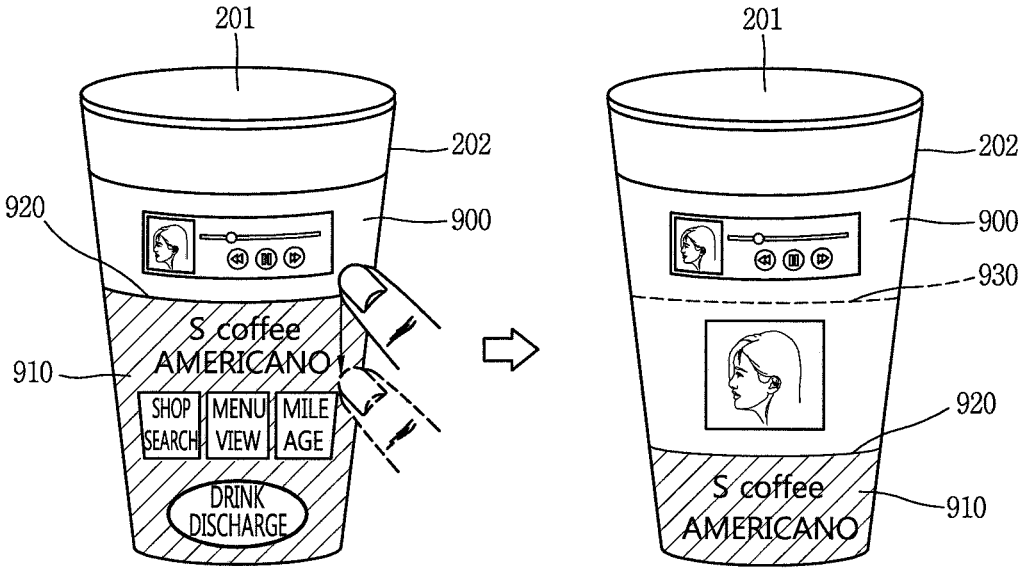

Hereinafter, a method of controlling a display area of a display unit, based on a user's control command, in the smart cup according to the embodiment of the present disclosure, will be described. FIGS. 9A and 9B are conceptual views illustrating a method of controlling a display area of a display unit, based on a user's control command, in the smart cup according to the embodiment of the present disclosure.

The smart cup 200 according to the embodiment of the present disclosure may include a display unit 251 having a shape surrounding an outside of the main body 202. The display unit 251 having this structure displays information related to a drinking substance contained in the internal state of the smart cup in a specific area determined based on a capacity of the drinking substance contained in the internal space, thereby more intuitively providing the information to the user.

More specifically, when a drinking substance is contained in the internal space of the main body 202, the controller 280 may divide the display unit 251 into a plurality of areas according to a capacity of the drinking substance. For example, as shown in a first drawing of FIG. 9A, the controller 280 may divide the display unit 251 into two areas, i.e., a first area 910 corresponding to an internal space in which the drinking substance is contained and a second area 900 corresponding to an internal space in which the drinking substance is not contained. Here, the internal space in which the drinking substance is contained and the internal space in which the drinking substance is not contained may be determined according to a capacity of the drinking substance.

In this case, the controller 280 may display information related to the drinking substance in the first area 910 corresponding to the internal space in which the drinking substance is contained, and display screen information related to a currently executed function in the second area 900 corresponding to the internal space in which the drinking substance is not contained. For example, as shown in the first drawing of FIG. 9A, when the drinking substance contained in the internal space is a drink of S coffee shop, menus, mileages, discount information, etc. of the S coffee shop may be displayed in the first area 910 corresponding to the internal space in which the drinking substance is contained, and screen information related to a currently executed music replay function may be displayed in the second area 900 corresponding to the internal space in which the drinking substance is not contained.

In the state in which the display unit 251 is divided into the first area 910 and the second area 900, the controller 280 may changes the sizes of the first and second areas 910 and 900, based on that a drag in a first direction is applied to a boundary area 920 between the first and second areas 910 and 900. For example, as shown in a second drawing of FIG. 9A, the controller 280 may expand the second area 900 by a size corresponding to a drag length where the drag in the first direction is applied to the boundary area 920 between first and second areas 910 and 900, and reduce the first area 910 by the size where the second area 900 is expanded.

In addition, if the second area 900 is expanded, the controller 280 may further display, on the second area 900, additional information of the screen information displayed before the second area 900 is expanded. Also, if the first area 910 is reduced, the controller 280 may allow at least portion of the screen information displayed before the first area 910 is reduced to disappear on the first area 910.

On the contrary, in the state in which the display unit 251 is divided into the first area 910 and the second area 900, the controller 280 may change the sizes of the first and second areas 910 and 900, based on that a drag in a second direction opposite to the first direction is applied to the boundary area 920 between the first and second areas 910 and 900. For example, as shown in a third drawing of FIG. 9A, the controller 280 may expand the first area 910 by a size corresponding to a drag length where the drag in the second direction opposite to the first direction is applied to the boundary area 920 between the first and second areas 910 and 900, and reduce the second area 900 by a size where the first area 910 is expanded.

In addition, if the first area 910 is expanded, the controller 280 may further display additional information of the screen information displayed before the first area 910 is expanded. If the second area 900 is reduced, the controller 280 may allow at least a portion of the screen information before the second are 900 is reduced to disappear on the second area 900.

Meanwhile, when the size of an area divided into a plurality of areas is changed based on a user's control command, the controller 280 may display guide information representing a capacity of the drinking substance contained in the internal space of the main body. For example, as shown in first and second drawings of FIG. 9B, when the sizes of the first and second areas 910 and 900 are changed, the controller 280 may display guide information 930 representing a capacity of the drinking substance contained in the internal space of the main body 202. Also, the display position of the guide information 930 representing a capacity of the drinking substance contained in the internal space of the main body 202 may be changed as the capacity of the drinking substance is changed. Thus, the user can always recognize a current capacity of the drinking substance through the display unit 251, regardless of a change in the size of the area divided into the plurality of areas in the display unit 251.

In the above, the method of controlling the area divided into the plurality of areas in the display unit has been described.

Hereinafter, a method of providing information related to position information and time information, based on the position information and the time information in the smart cup according to the embodiment of the present disclosure, will be described. FIGS. 10A, 10B, 11A, and 11B are conceptual views illustrating a method of providing information related to position information and time information, based on the location information and the time information.

The smart cup 200 according to the embodiment of the present disclosure may further include a position sensing unit for receiving position information. The position sensing unit may include at least one of a GPS sensor and a beacon signal sensing unit.

The controller 280 may display, on the display unit 251, information related to at least one of position information and time information, based on the at least one of the position information and the time information. The information related to the position information may include shop information, discount coupon information, menu information, etc. The information related to the time information may be information detected based on a user's use pattern for each time zone. For example, the information related to the time information may be information related to a specific place when the user is always located at the specific place in the morning.

Figure 10A:
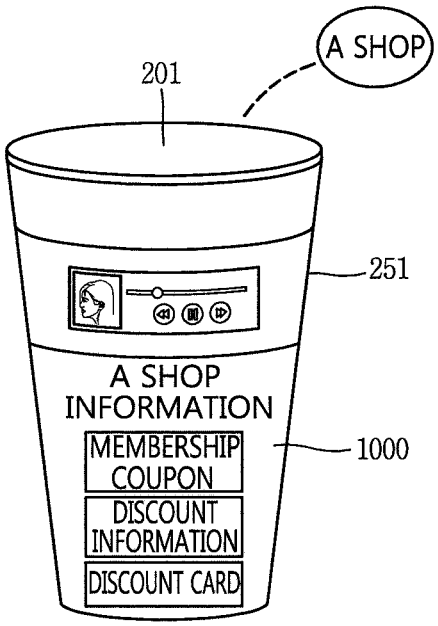
FIGS. 10A, 10B, 11A, and 11B are conceptual views illustrating a method of providing information related to position information and time information, based on the location information and the time information.
Figure 10B:
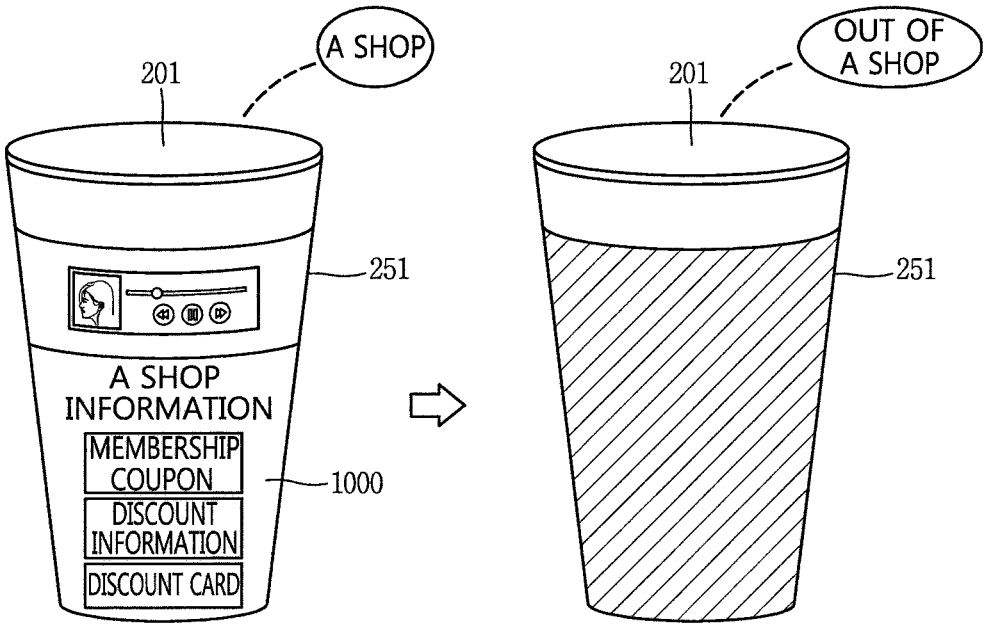

More specifically, when the position of the smart cup 200 corresponds to a predetermined position, the controller 280 may display, on the display unit 251, information related to the predetermined position. For example, as shown in FIG. 10A, when the position of the smart cup 200 corresponds to the position of A shop, the controller 280 may display, on the display unit 251, information 1000 related to the A shop, including membership information, discount information, discount card information, etc. of the A shop. Accordingly, the user can conveniently execute functions related to the A shop.

When the smart cup 200 is moved from the predetermined position to another position, the controller 280 may allow the information related to the predetermined position to disappear on the display unit 251. For example, as shown in first and second drawings of FIG. 10B, when the smart cup 200 is out of the position of the A shop, the controller 280 may allow the information 1000 related to the A shop to disappear on the display unit 251. Therefore, when the smart cup 200 is out of the position of the A shop, the user may no longer receive the information related to the A shop.

Although not shown in these figures, the controller 280 may also provide multimedia content (e.g., music) information replayed in the shop, as the information related to the A shop.

Figure 11A:
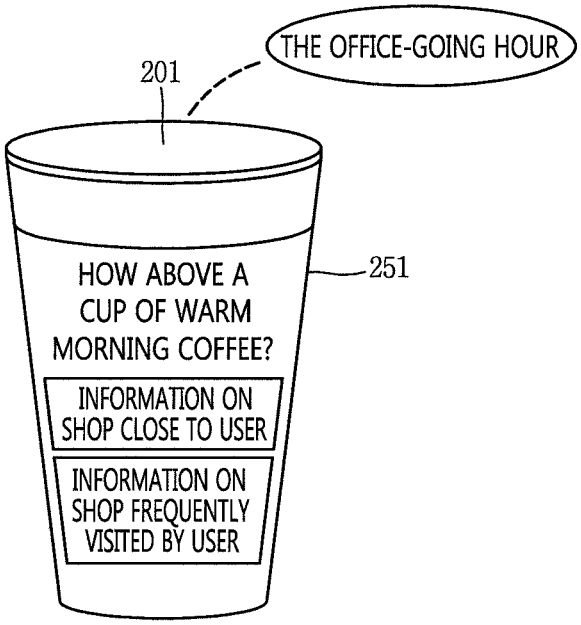

Alternatively, when the current time corresponds to a predetermined time, the controller 280 may display information related to the predetermined time, on the display unit 251. As an example, as shown in FIG. 11*a*, when the current time corresponding to an office-going hour (e.g., 7 am to 9 am), the controller 280 may provide information related to a function frequently used at the office-going hour. For example, if a use pattern where the user frequently visits a coffee shop is sensed, the controller 280 may display, on the display unit 251, information on a shop frequently visited by the user or information on a shop close based on the current position.

Figure 11B:
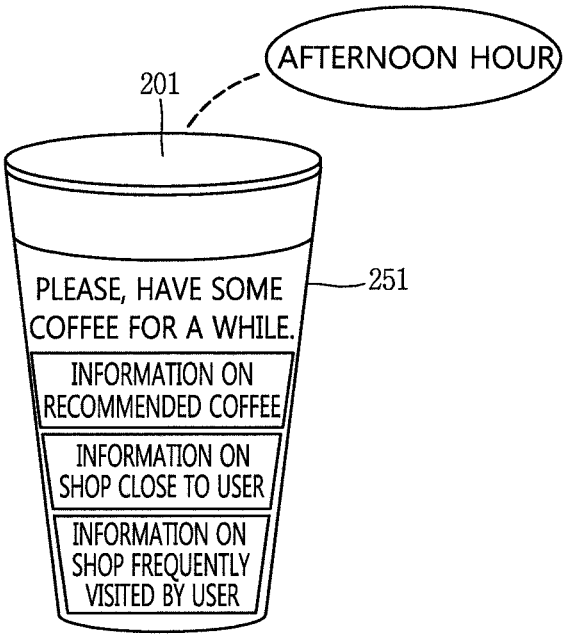

As another example, as shown in FIG. 11B, when the current time corresponds to an afternoon hour (e.g., 2 pm to 3 pm), the controller 280 may provide rest information. The rest information may be detected based on position information at a user's specific time zone.

Meanwhile, when the drinking substance is not contained in the internal space of the main body 202, the controller 280 may determine whether the information related to the position information and the time information is to be output. For example, when the drinking substance is not contained in the internal space of the main body 202, the controller 280 may output the information related to the position information and the time. When the drinking substance is contained in the internal space of the main body 202, the controller 280 may not output the information related to the position information and the time information.

In the above, the method of providing the information related to the position information and the time information, based on the position information and the time information has bee described. Accordingly, the user can conveniently receive various functions available together with the function of containing a drinking substance in the smart cup.

Figure 12:
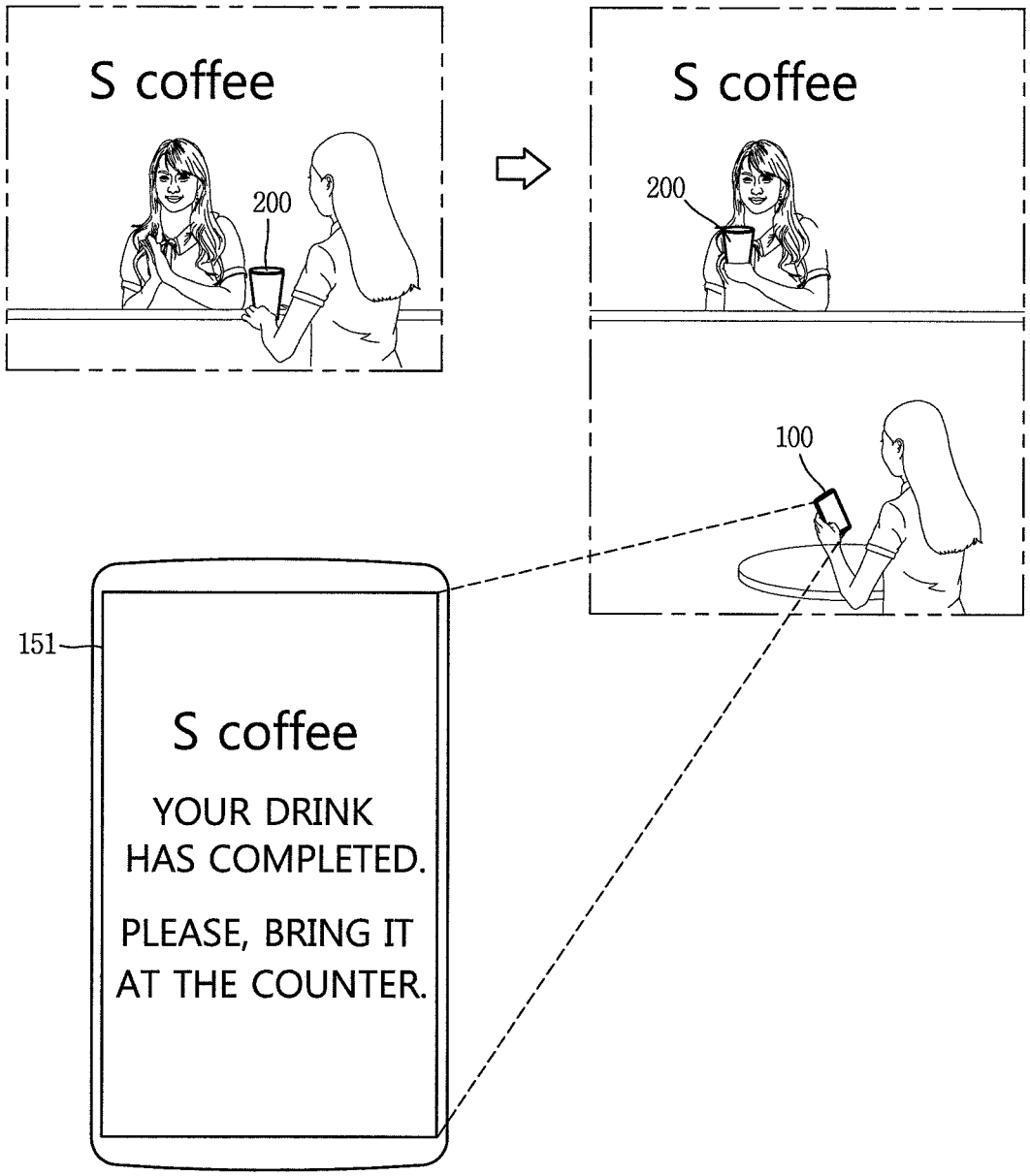
FIG. 12 is a conceptual view illustrating a method of executing a function related to a specific position by using the mobile terminal linked with the smart cup located at the specific position.

Hereinafter, a method of executing a function related to a specific position by using the mobile terminal linked with the smart cup located at the specific position will be described. FIG. 12 is a conceptual view illustrating a method of executing a function related to a specific position by using the mobile terminal linked with the smart cup located at the specific position.

The smart cup 200 according to the embodiment of the present disclosure may be linked with the mobile terminal through near-field communication. The linkage may mean a state in which the near-field communication can be performed. Here, the mobile terminal is an electronic device which can be linked with the smart cup 200, and may be a smart phone, a smart watch, etc.

A conventional method may be used as the method of linking the mobile terminal with the smart cup 200, and detailed description of the method will be omitted.

When the relative distance between the smart cup 200 and the mobile terminal is longer than a predetermined distance in the state in which the smart cup 200 is linked with a specific mobile terminal, the controller 280 may transmit, to the mobile terminal, notification information for notifying a state of the smart cup 200. That is, when the user of the smart cup 200 does not directly have the smart cup 200, the user may receive notification information related to the smart cup 200 through the mobile terminal linked with the smart cup 200.

More specifically, when the information related to a drinking substance contained in the internal space of the smart cup 200 satisfies a predetermined condition, the controller 280 may transmit, to the mobile terminal, notification information for notifying a state of the smart cup 200. The predetermined condition may be a condition in which the capacity of the drinking substance corresponds to a predetermined capacity.

The mobile terminal may output the notification information in visual, auditory, and haptic ways such that the user recognizes the notification information. Thus, the user at a long distance can recognize the state of the smart cup through the mobile terminal.

For example, as shown in FIG. 12, the user may deliver the smart cup 200 to a shop staff. In this case, the controller 280 of the smart cup 200 may sense that the relative distance with respect to the user's mobile terminal is longer than the predetermined distance.

In this state, when the capacity of the drinking substance contained in the internal space of the main body 202 corresponds to a predetermined capacity, the controller 280 of the smart cup 200 may transmit, to the mobile terminal, notification information for notifying that the capacity of the drinking substance has been filled.

The mobile terminal may output the notification information as a vibration or sound. Alternatively, the mobile terminal may display, on the display unit 251, notification information called "Your drink has completed. Please, bring it at the counter." Accordingly, the user can recognize a state of the smart cup 200 at a long distance. Further, the user can variously use the smart cup 200 in linkage with the mobile terminal.

When the capacity of the drinking substance contained in the internal space of the smart cup 200 corresponds to the predetermined capacity, the controller 280 may automatically perform payment related to the drinking substance. More specifically, the controller 280 may automatically perform payment through a payment means provided in the smart cup 200 according to a kind of the drinking substance. Thus, if the smart cup 200 is provided to the counter, the user can perform, at one time, processes from the payment to the notification information.

In the above, the method of executing a function through the linkage between the smart cup and the mobile terminal has been described. Accordingly, in the present disclosure, the conventional notification bell can be replaced with the mobile terminal.

Figure 13A:
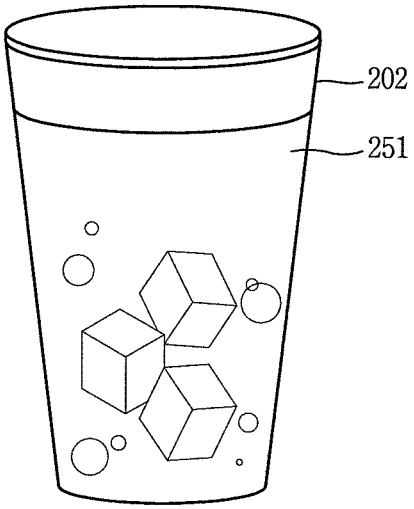
FIGS. 13A and 13B are conceptual views illustrating a method of displaying, on the display unit, information related to a drinking substance contained in an internal space of the main body of the smart cup.
Figure 13B:
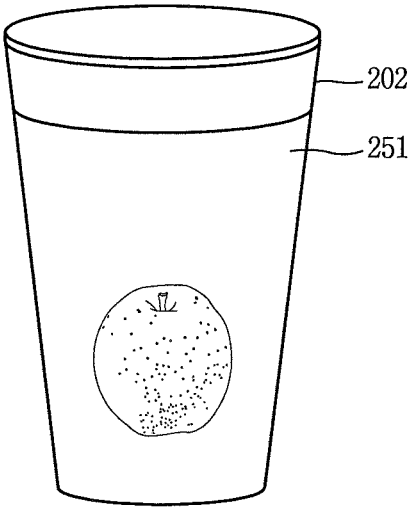

Hereinafter, a method of displaying, on the display unit, information related to a drinking substance contained in the internal space of the main body of the smart cup will be described. FIGS. 13A and 13B are conceptual views illustrating a method of displaying, on the display unit, information related to a drinking substance contained in the internal space of the main body of the smart cup.

When a drinking substance is contained in the internal space of the main body 202 of the smart cup 200, the controller 280 may display, on the display unit 251, information related to the drinking substance.

As an example, as shown in FIG. 13A, if it is decided that the drinking substance is a carbonated drink having a low temperature, the controller 280 may display, on the display unit 251, an image of ice and carbonic acid. As another example, as shown in FIG. 13B, when a fruit component is included in the drinking substance, the controller 280 may display a fruit image.

Accordingly, the user can use the smart cup having various external appearances.

The smart cup according to the embodiment of the present disclosure can execute various functions, based on a motion of the main body and information related to a drinking substance. Thus, the user can use various functions as well as the function of containing the drinking substance by using the smart cup.

Also, the smart cup according to the embodiment of the present disclosure prevents a drinking substance from being discharged to the outside when additional functions are executed except the function of containing the drinking substance, so that it is possible to simultaneously use the function of containing the drinking substance and the additional functions.

Various embodiments may be implemented using a machine-readable medium having instructions stored thereon for execution by a processor to perform various methods presented herein. Examples of possible machine-readable mediums include HDD (Hard Disk Drive), SSD (Solid State Disk), SDD (Silicon Disk Drive), ROM, RAM, CD-ROM, a magnetic tape, a floppy disk, an optical data storage device, the other types of storage mediums presented herein, and combinations thereof. If desired, the machine-readable medium may be realized in the form of a carrier wave (for example, a transmission over the Internet). The processor may include the controller 180 of the mobile terminal.

The invention claimed is:

1. A smart cup comprising:

a main body having an opening;

a cover configured to cover at least one portion of the opening;

a driving unit configured to move the cover to open and close the at least one portion of the opening;

a motion sensor configured to sense a motion of the main body;

a proximity sensor configured to sense an object contacted with or adjacent to the opening; and a controller configured to:

control the driving unit to move the cover to open the at least one portion of the opening in response to the motion sensor sensing the motion of the main body and the proximity sensor sensing the object contacted with or adjacent to the opening, and control the driving unit to move the cover to close the at least one portion of the opening in response to the motion sensor sensing the motion of the main body and the proximity sensor not sensing the object contacted with or adjacent to the opening.

2. The smart cup of claim 1, wherein the main body comprises an internal space configured to contain a drinking substance therein, wherein the smart cup further comprises a drinking substance sensor configured to sense information related to the drinking substance contained in the internal space of the main body, and wherein the controller is further configured to control a speed at which the cover is moved according to a capacity of the drinking substance.

3. The smart cup of claim 1, wherein the main body comprises an internal space configured to contain a drinking substance and an outside surrounding the internal space, wherein the smart cup further comprises a touch screen surrounding at least one portion of the outside of the main body, and wherein, when the proximity sensor does not sense the object contacted with or adjacent to the opening and the motion sensor senses the motion of the main body, the controller is further configured to execute any one of a first function and a second function, based on an area in which a touch is sensed on the touch screen.

4. The smart cup of claim 3, wherein the first function includes moving the cover such that the drinking substance contained in the internal space of the main body is discharged, and the second function includes transmitting, to an external device, information displayed in the area in which the touch is sensed, through wireless communication.

5. The smart cup of claim 3, wherein, when the proximity sensor does not sense the object contacted with or adjacent to the opening and the motion sensor senses the motion of the main body, the controller is further configured to display a graphic object related to the first function and a graphic object related to the second function in an area contacted with or adjacent to a user's finger on the touch screen.

6. The smart cup of claim 1, wherein the main body comprises an internal space configured to contain a drinking substance and an outside surrounding the internal space, wherein the smart cup further comprises a display surrounding at least one portion of the main body, and a drinking substance sensor configured to sense information related to the drinking substance contained in the internal space of the main body, and wherein the controller is further configured to display additional information on the display, based on the information related to the drinking substance contained in the internal space.

7. The smart cup of claim 6, wherein the information related to the drinking substance includes at least one of a type of the drinking substance, a manufacturer of the drinking substance, calorie information of the drinking substance, a capacity of the drinking substance, a specific component included in the drinking substance, and a concentration of the specific component.

8. The smart cup of claim 7, wherein the additional information includes recipe information corresponding to the type of the drinking substance contained in the internal substance.

9. The smart cup of claim 7, wherein the controller is further configured to:

divide the display into a plurality of areas, based on the capacity of the drinking substance contained in the internal space, display the information related to the drinking substance in an area corresponding to a portion of the internal space in which the drinking substance is contained among the plurality of areas, and display screen information of a function being executed in the smart cup in an area corresponding to another portion of the internal space in which the drinking substance is not contained among the plurality of areas.

10. The smart cup of claim 9, wherein the controller is further configured to change sizes of the plurality of areas, based on a drag applied to a boundary area between the plurality of areas.

11. The smart cup of claim 10, wherein the controller is further configured to change a display degree of screen information displayed in each of the plurality of areas, based on changing sizes of the plurality of areas.

12. The smart cup of claim 10, wherein the controller is further configured to display guide information for representing a capacity of the drinking substance even though the sizes of the plurality of areas are changed.

13. The smart cup of claim 1, further comprising:

a position sensor configured to sense position information; and a display, wherein, when a position sensed through the position sensing unit corresponds to a predetermined position, the controller is further configured to display information related to the predetermined position on the display.

14. The smart cup of claim 13, wherein the information related to the predetermined position includes at least one of shop information, discount coupon information, and menu information.

15. A method of controlling a smart cup including a main body with an opening, the method comprising:

sensing, via a motion sensor of the smart cup, a motion of the main body;

sensing, via a proximity sensor of the smart cup, an object contacted with or adjacent to the opening;

controlling a driving unit of the smart cup to move the cover to open at least one portion of the opening in response to the motion sensor sensing the motion of the main body and the proximity sensor sensing the object contacted with or adjacent to the opening; and controlling the driving unit to move the cover to close the at least one portion of the opening in response to the motion sensor sensing the motion of the main body and the proximity sensor not sensing the object contacted with or adjacent to the opening.

16. The method of claim 15, wherein the main body comprises an internal space configured to contain a drinking substance therein, wherein the smart cup further comprises a drinking substance sensor configured to sense information related to the drinking substance contained in the internal space of the main body, and wherein the method further comprising controlling a speed at which the cover is moved according to a capacity of the drinking substance.

17. The method of claim 15, wherein the main body comprises an internal space configured to contain a drinking substance and an outside surrounding the internal space, wherein the smart cup further comprises a touch screen surrounding at least one portion of the outside of the main body, and wherein, when the proximity sensor does not sense the object contacted with or adjacent to the opening and the motion sensor senses the motion of the main body, the method further comprising executing any one of a first function and a second function, based on an area in which a touch is sensed on the touch screen.

18. The method of claim 17, wherein the first function includes moving the cover such that the drinking substance contained in the internal space of the main body is discharged, and the second function includes transmitting, to an external device, information displayed in the area in which the touch is sensed, through wireless communication.

19. The method of claim 17, wherein, when the proximity sensor does not sense the object contacted with or adjacent to the opening and the motion sensor senses the motion of the main body, the method further comprising displaying a graphic object related to the first function and a graphic object related to the second function in an area contacted with or adjacent to a user's finger on the touch screen.

20. The method of claim 15, wherein the main body comprises an internal space configured to contain a drinking substance and an outside surrounding the internal space, wherein the smart cup further comprises a display surrounding at least one portion of the main body, and a drinking substance sensor configured to sense information related to the drinking substance contained in the internal space of the main body, and wherein the method further comprising displaying additional information on the display, based on the information related to the drinking substance contained in the internal space.

* * * * *